US010401064B2

(12) United States Patent
Lee et al.

(10) Patent No.: US 10,401,064 B2
(45) Date of Patent: Sep. 3, 2019

(54) HEAT PUMP AND FLOW PATH SWITCHING APPARATUS

(71) Applicant: SAMSUNG ELECTRONICS CO., LTD., Suwon-si, Gyeonggi-do (KR)

(72) Inventors: Suk Ho Lee, Suwon-si (KR); Il Yong Cho, Suwon-si (KR); Hyung Mo Koo, Suwon-si (KR); Min Chang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 840 days.

(21) Appl. No.: 14/337,674

(22) Filed: Jul. 22, 2014

(65) Prior Publication Data

US 2015/0027154 A1 Jan. 29, 2015

(30) Foreign Application Priority Data

Jul. 25, 2013 (KR) ..... 10-2013-0088069

(51) Int. Cl.
*F25B 41/04* (2006.01)
*F25B 13/00* (2006.01)
*F25B 30/02* (2006.01)

(52) U.S. Cl.
CPC ..... *F25B 41/046* (2013.01); *F25B 13/00* (2013.01); *F25B 30/02* (2013.01);
(Continued)

(58) Field of Classification Search
CPC .. F25B 2313/02732; F25B 2313/02741; F25B 2313/007; F25B 2313/025; F25B 41/046
See application file for complete search history.

(56) References Cited

U.S. PATENT DOCUMENTS 5,142,879 A * 9/1992 Nakamura ..... F24F 3/065 62/160
5,156,014 A * 10/1992 Nakamura ..... F24F 3/065 62/160

(Continued)

FOREIGN PATENT DOCUMENTS

CN 1103239 5/1995
CN 101065623 10/2007

(Continued)

OTHER PUBLICATIONS

Extended European Search Report dated Jun. 30, 2015 from European Patent Application 14172418.7, 7 pages.

(Continued)

*Primary Examiner* — Kun Kai Ma
(74) *Attorney, Agent, or Firm* — Staas & Halsey LLP

(57) ABSTRACT

A heat pump performs a simultaneous air-conditioning and heating operation through the addition of a flow path switching apparatus. The heat pump may include a plurality of outdoor units, a plurality of indoor units, and a plurality of flow path switching apparatuses that switch a flow path between an outdoor unit and an indoor unit. A refrigerant flow path may be formed from the outdoor unit to the indoor unit via a high-pressure gas pipe. The flow path switching apparatuses may switch a flow path so that a refrigerant flow path is formed from the indoor unit to the outdoor unit via a low-pressure gas pipe. The heat pump may further include an indoor unit mode controller that is connected to the plurality of outdoor units through a liquid pipe, and which is connected to each of the plurality of flow path switching apparatuses.

7 Claims, 15 Drawing Sheets

(52) U.S. Cl.
CPC ... *F25B 2313/007* (2013.01); *F25B 2313/025* (2013.01); *F25B 2313/0231* (2013.01); *F25B 2313/02732* (2013.01); *F25B 2313/02741* (2013.01)

(56) References Cited

U.S. PATENT DOCUMENTS

| | | | | |
|---|---|---|---|---|
| 5,237,833 | A * | 8/1993 | Hayashida | F24F 3/065 62/228.1 |
| 5,490,399 | A * | 2/1996 | Sada | F25B 13/00 62/160 |
| 9,316,421 | B2 * | 4/2016 | Tanaka | F25B 41/04 |
| 2006/0254294 | A1 * | 11/2006 | Shimamoto | F24F 3/065 62/238.7 |
| 2009/0145151 | A1 * | 6/2009 | Wakamoto | F25B 9/008 62/259.1 |
| 2010/0043467 | A1 * | 2/2010 | Kawano | F25B 13/00 62/129 |
| 2010/0107665 | A1 * | 5/2010 | Kawano | F25B 13/00 62/149 |
| 2010/0319376 | A1 * | 12/2010 | Kawano | F25B 13/00 62/238.6 |
| 2011/0048054 | A1 * | 3/2011 | Sekine | F25B 13/00 62/324.6 |
| 2011/0174002 | A1 | 7/2011 | Jang et al. | |
| 2013/0081417 | A1 * | 4/2013 | Tamura | F25B 13/00 62/160 |
| 2014/0007601 | A1 * | 1/2014 | Tamura | F24F 1/20 62/160 |
| 2014/0026603 | A1 * | 1/2014 | Toya | F24F 1/0003 62/129 |
| 2015/0292756 | A1 * | 10/2015 | Takenaka | F25B 13/00 62/160 |
| 2016/0209085 | A1 * | 7/2016 | Kim | F25B 13/00 |
| 2016/0245536 | A1 * | 8/2016 | Iwasaki | F25B 49/02 |

FOREIGN PATENT DOCUMENTS

| | | |
|---|---|---|
| CN | 101589277 | 11/2009 |
| CN | 103032982 | 4/2013 |
| EP | 2 241 843 | 10/2010 |
| JP | 2010-276239 | 12/2010 |
| WO | 2012/008148 | 1/2012 |

OTHER PUBLICATIONS

Chinese Office Action dated Sep. 14, 2017 in Chinese Patent Application No. 201410343219.1.
Chinese Office Action dated May 29, 2018 in Chinese Patent Application No. 201410343219.1.

* cited by examiner

HEAT PUMP AND FLOW PATH SWITCHING APPARATUS

CROSS-REFERENCE TO RELATED APPLICATIONS

This application claims the benefit of Korean Patent Application No. 10-2013-0088069, filed on Jul. 25, 2013 in the Korean Intellectual Property Office, the disclosure of which is incorporated herein by reference.

BACKGROUND

1. Field

Embodiments disclosed herein relate to a heat pump, and more particularly, to a heat pump in which a plurality of indoor units are installed at a single outdoor unit so that an air-conditioning operation and a heating operation can be performed.

2. Description of the Related Art

The market for a heat pump that performs air-conditioning and heating by binding a plurality of indoor units and a plurality of outdoor units (or a single outdoor unit) as a single piping system is gradually increasing owing to comparatively simple installation and a low price. However, the heat pump has disadvantages that cannot simultaneously meet users' various air-conditioning and heating operation needs. This is because there is a limitation that, when an indoor heat exchanger operates in an air-conditioning operation mode, i.e., when the indoor heat exchanger is used as an evaporator, an outdoor heat exchanger is used as a condenser. Accordingly, due to a seasonal factor, such as the change of seasons, in which an individual user's operation need for each of the plurality of indoor units may be diverse, or due to an environmental factor, such as a room of a hotel in which users have various tastes, the heat pump having one outdoor unit cannot satisfy the air-conditioning/heating needs of all users.

SUMMARY

Therefore, it is an aspect of the disclosure to provide a heat pump that is capable of performing a simultaneous air-conditioning and heating operation by adding only a flow path switching apparatus to the heat pump.

Additional aspects of the invention will be set forth in part in the description which follows and, in part, will be apparent from the description, or may be learned by practice of the invention.

In accordance with an aspect of the disclosure, a heat pump may include a plurality of outdoor units, a plurality of indoor units, and a plurality of flow path switching apparatuses that switch a flow path between an outdoor unit and an indoor unit for heating from among the plurality of outdoor units and the plurality of indoor units so that a refrigerant flow path is formed from the outdoor unit to the indoor unit via a high-pressure gas pipe and that switch a flow path between an outdoor unit and an indoor unit for air-conditioning from among the plurality of outdoor units and the plurality of indoor units so that a refrigerant flow path is formed from the indoor unit to the outdoor unit via a low-pressure gas pipe. The heat pump may further include an indoor unit mode controller that is connected to the plurality of outdoor units through a liquid pipe, is connected to each of the plurality of flow path switching apparatuses via the high-pressure gas pipe and the low-pressure gas pipe, and is connected to each of the plurality of indoor units via a refrigerant circulation pipe so that a refrigerant is circulated between the plurality of outdoor units and the plurality of indoor units via the liquid pipe and the high-pressure gas pipe, the low-pressure gas pipe, and the refrigerant circulation pipe.

Each of the plurality of flow path switching apparatuses may include a 3-way valve for switching a flow path so that one of the high-pressure gas pipe and the low-pressure gas pipe is connected to one from among the plurality of outdoor units. Each of the plurality of flow path switching apparatuses may further include a bypass valve disposed between the high-pressure gas pipe and the low-pressure gas pipe so as to equalize pressure inside the high-pressure gas pipe and pressure inside the low-pressure gas pipe.

Each of the plurality of outdoor units may include a compressor, an outdoor heat exchanger, an electronic expansion valve, and a 4-way valve that connects an ejection side of the compressor to one side of the outdoor heat exchanger or the flow path switching apparatus and connects an inhalation side of the compressor to one side of the outdoor heat exchanger or the flow path switching apparatus.

In accordance with another aspect of the disclosure, a heat pump may include a single outdoor unit including a compressor, an outdoor heat exchanger, an electronic expansion valve, and a 4-way valve that connects an ejection side of the compressor to one side of the outdoor heat exchanger or a flow path switching apparatus and connects an inhalation side of the compressor to one side of the outdoor heat exchanger or the flow path switching apparatus, a plurality of indoor units to which a low-pressure gas pipe and a high-pressure gas pipe are connected, and a refrigerant branching pipe that branches from a place or point where the 4-way valve and one side of the outdoor heat exchanger are connected to each other. The flow path switching apparatus may include a first 3-way valve for switching a flow path so that one of the high-pressure gas pipe and the low-pressure gas pipe is connected to the 4-way valve via the refrigerant branching pipe and a second 3-way valve for switching a flow path so that one of the high-pressure gas pipe and the low-pressure gas pipe is connected to one of the ejection side and the inhalation side of the compressor via the 4-way valve. The heat pump may further include an indoor unit mode controller that is connected to the single outdoor unit via a liquid pipe, is connected to the flow path switching apparatus via the high-pressure gas pipe and the low-pressure gas pipe, and is connected to each of the plurality of indoor units via a refrigerant circulation pipe so that a refrigerant is circulated between the single outdoor unit and the plurality of indoor units via the liquid pipe and the high-pressure gas pipe, the low-pressure gas pipe, and the refrigerant circulation pipe.

A first check valve that induces the flow of the refrigerant in a direction in which the refrigerant flows out from the first 3-way valve, may be installed at the high-pressure gas pipe connected to the first 3-way valve, and a second check valve that induces the flow of the refrigerant in a direction in which the refrigerant flows into the first 3-way valve, may be installed at the low-pressure gas pipe connected to the first 3-way valve.

In a main air-conditioning mode in which a load of air-conditioning is larger than a load of heating, a flow path of the 4-way valve, the first 3-way valve, and the first check valve may be switched so that the refrigerant ejected from the compressor flows into the high-pressure gas pipe via the refrigerant branching pipe and the first 3-way valve.

In a main heating mode in which a load of the heating is larger than a load of air-conditioning, a flow path of the second check valve, the first 3-way valve, and the 4-way valve may be switched so that the refrigerant flowing through the low-pressure gas pipe is recovered to the inhalation side of the compressor via the first 3-way valve and the refrigerant branching pipe.

A bypass valve may be further installed between the high-pressure gas pipe and the low-pressure gas pipe of the flow path switching apparatus.

In accordance with an aspect of the disclosure, a flow path switching apparatus may be installed on a high-pressure gas pipe and a low-pressure gas pipe that connect a plurality of outdoor units and a plurality of indoor units of a heat pump, may switch a refrigerant flow path so that a high-pressure gaseous refrigerant ejected from a compressor of each of the plurality of outdoor units flows into each of the plurality of indoor units via the high-pressure gas pipe, and may switch a refrigerant flow path so that a low-pressure gaseous refrigerant recovered from each of the indoor units to each of the outdoor units flows into the compressor of each of the outdoor units via the low-pressure gas pipe.

The flow path switching apparatus may include a 3-way valve for switching a flow path so that one of the high-pressure gas pipe and the low-pressure gas pipe is connected to one from among the plurality of outdoor units.

The flow path switching apparatus may further include a bypass valve disposed between the high-pressure gas pipe and the low-pressure gas pipe so as to equalize pressure inside the high-pressure gas pipe and pressure inside the low-pressure gas pipe.

The flow path switching apparatus may be an additional apparatus separated from the outdoor units. The flow path switching apparatus may be integrally disposed within the outdoor units.

In accordance with an aspect of the disclosure, a flow path switching apparatus may include a first 3-way valve that is installed on a high-pressure gas pipe and a low-pressure gas pipe that connect an outdoor unit and a plurality of indoor units of a heat pump, that switches a refrigerant flow path so that a high-pressure gaseous refrigerant flowing through the high-pressure gas pipe flows into the plurality of indoor units via a refrigerant branching pipe, and that switches a refrigerant flow path so that a low-pressure gaseous refrigerant recovered from the plurality of indoor units through the low-pressure gas pipe flows into a compressor of the outdoor unit via the refrigerant branching pipe. The flow path switching apparatus may further include a second 3-way valve that is installed on the high-pressure gas pipe and the low-pressure gas pipe, that switches a refrigerant flow path so that a high-pressure gaseous refrigerant flowing through the high-pressure gas pipe flows into the plurality of indoor units, and that switches a refrigerant flow path so that a low-pressure gaseous refrigerant recovered from the plurality of indoor units through the low-pressure gas pipe flows into a compressor of the outdoor unit.

A first check valve that induces the flow of the refrigerant in a direction in which the refrigerant flows out from the first 3-way valve, may be installed at the high-pressure gas pipe connected to the first 3-way valve, and a second check valve that induces the flow of the refrigerant in a direction in which the refrigerant flows into the first 3-way valve, may be installed at the low-pressure gas pipe connected to the first 3-way valve.

In a main air-conditioning mode in which a load of air-conditioning is larger than a load of heating, a flow path of a 4-way valve included in the outdoor unit, the first 3-way valve, and the first check valve may be switched so that the refrigerant ejected from the compressor flows into the high-pressure gas pipe via the refrigerant branching pipe and the first 3-way valve.

In a main heating mode in which a load of the heating is larger than a load of air-conditioning, a flow path of the second check valve, the first 3-way valve, and the 4-way valve of the outdoor unit may be switched so that the refrigerant flowing through the low-pressure gas pipe is recovered to the inhalation side of the compressor via the first 3-way valve and the refrigerant branching pipe.

A bypass valve may be further installed between the high-pressure gas pipe and the low-pressure gas pipe.

In accordance with an aspect of the disclosure, a heat pump may include a first outdoor unit and a second outdoor unit, a first indoor unit and a second indoor unit, a controller to connect the first and second outdoor units to the first and second indoor units using at least a first pipe and a second pipe, and a flow path switching apparatus including a first valve and a second valve.

When the first indoor unit requires a heating operation at a same time as the second indoor unit requires an air conditioning operation the first valve may be selectively positioned to cause refrigerant ejected from a first compressor of the first outdoor unit, to flow to the first indoor unit via the first pipe and the controller, and the second valve may be selectively positioned to cause refrigerant recovered from the second indoor unit via the controller and the second pipe, to flow into an inhalation side of a second compressor of the second outdoor unit.

When the first indoor unit requires an air conditioning operation at a same time as the second indoor unit requires an air conditioning operation the first valve and the second valve may be selectively positioned to cause refrigerant recovered from the first and second indoor units via the controller and the second pipe, to flow into an inhalation side of the first and second compressors, and refrigerant does not flow through the first pipe.

When the first indoor unit requires a heating operation at a same time as the second indoor unit requires a heating operation, the first valve and the second valve may be selectively positioned to cause refrigerant ejected from the first and second compressors to flow to the first and second indoor units via the first pipe and the controller, and refrigerant does not flow through the second pipe.

In accordance with an aspect of the disclosure, a heat pump may include a single outdoor unit, a plurality of indoor units, a controller to connect the outdoor unit to the plurality of indoor units using at least a first pipe, a second pipe, and a third pipe, and a flow path switching apparatus including a first valve and a second valve.

When the plurality of indoor units require a heating operation and an air conditioning operation at a same time, if demand from the plurality of indoor units for an air-conditioning operation is greater than demand for a heating operation, the first valve may be selectively positioned to cause refrigerant ejected from a compressor of the outdoor unit to flow to indoors unit requiring a heating operation via the first pipe and the controller, and the second valve may be selectively positioned to cause refrigerant recovered from the plurality of indoor units via the controller and the second pipe, to flow into an inhalation side of the compressor, and refrigerant ejected from the compressor further flows through the third pipe and the controller to an indoor unit requiring an air conditioning operation.

If demand from the plurality of indoor units for a heating operation is greater than demand for an air-conditioning operation, the first valve may be selectively positioned to cause refrigerant recovered from the plurality of indoor units via the controller and the second pipe, to flow into an inhalation side of the compressor, and the second valve may be selectively positioned to cause refrigerant ejected from the compressor, to flow to the plurality of indoor units via the first pipe and the controller, and refrigerant may be further recovered from the plurality of indoor units via the controller and the third pipe, and flows into the inhalation side of the compressor.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
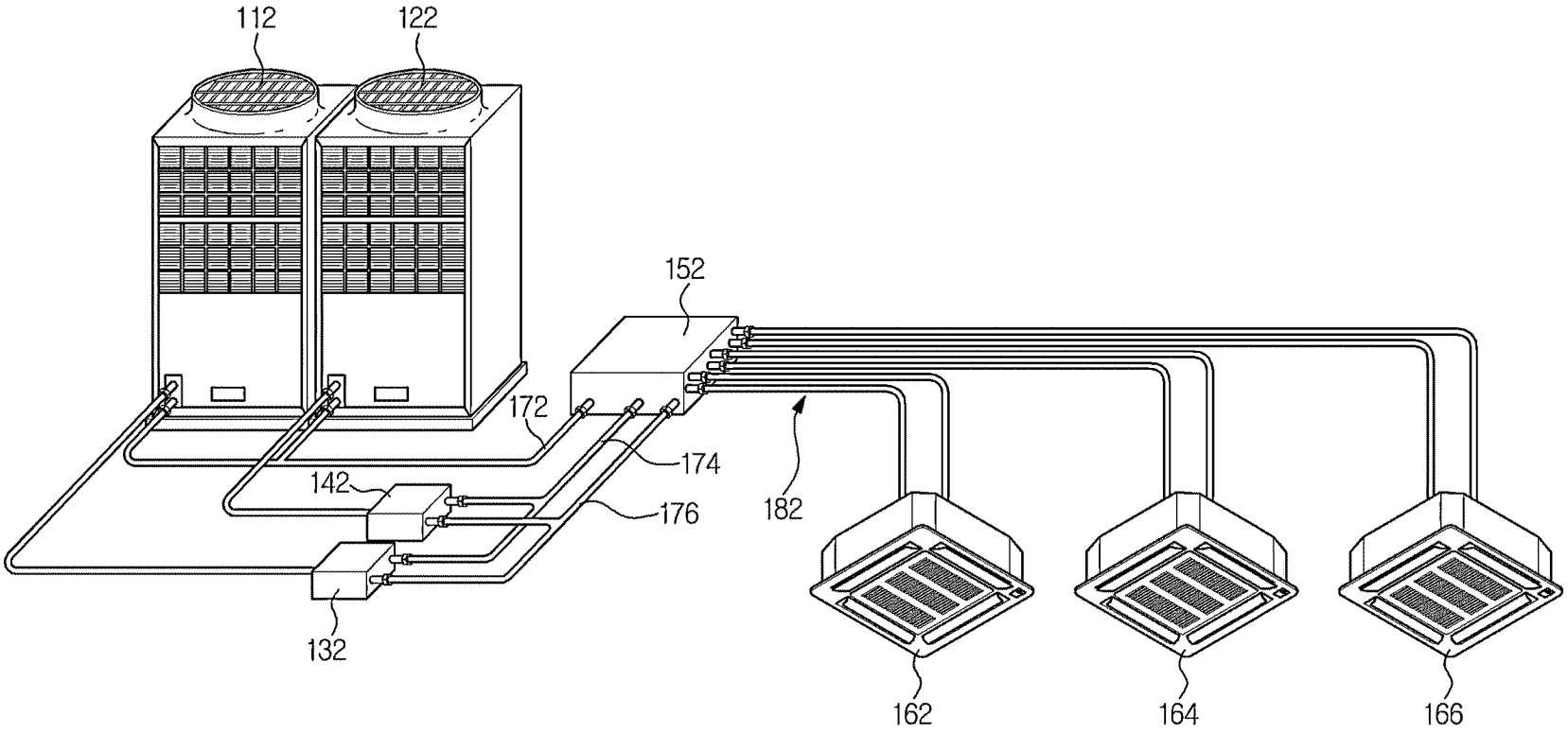
FIG. 1 illustrates a heat pump in accordance with an embodiment of the disclosure.

Reference will now be made in detail to the embodiments of the disclosure, examples of which are illustrated in the accompanying drawings, wherein like reference numerals refer to like elements throughout.

FIG. 1 illustrates a heat pump in accordance with an embodiment of the disclosure. The heat pump illustrated in FIG. 1 in accordance with an embodiment of the disclosure may include a plurality of outdoor units, for example, a first outdoor unit 112 and a second outdoor unit 122, two flow path switching apparatuses, for example, a first flow path switching apparatus 132 and a second flow path switching apparatus 142, an indoor unit mode controller 152, and a plurality of indoor units, for example, a first indoor unit 162, a second indoor unit 164, and a third indoor unit 166, wherein these elements are connected to one another via refrigerant circulation pipes and a refrigerant cycle is configured or arranged by this connection.

A plurality of refrigerant pipes, for example, a first refrigerant pipe 172, a second refrigerant pipe 174, and a third refrigerant pipe 176 may be connected between the indoor unit mode controller 152 and the plurality of outdoor units 112 and 122. Here, the first refrigerant pipe 172 may be a liquid pipe through which a liquid refrigerant flows, the second refrigerant pipe 174 may be a high-pressure gas pipe through which a high-pressure gaseous refrigerant flows, and the third refrigerant pipe 176 may be a low-pressure gas pipe through which a low-pressure gaseous refrigerant flows. The first refrigerant pipe 172 may be connected to each of the plurality of outdoor units 112 and 122 from the indoor unit mode controller 152. The second refrigerant pipe 174 and the third refrigerant pipe 176 may be connected to the plurality of outdoor units 112 and 122 via the first flow path switching apparatus 132 and the second flow path switching apparatus 142, respectively. That is, the first flow path switching apparatus 132 may switch a refrigerant flow path so that the refrigerant flows between the first outdoor unit 112 and the indoor unit mode controller 152 via one of the second refrigerant pipe 174 and the third refrigerant pipe 176, and the second flow path switching apparatus 142 may switch a refrigerant flow path so that the refrigerant flows between the second outdoor unit 122 and the indoor unit mode controller 152 via one of the second refrigerant pipe 174 and the third refrigerant pipe 176. A refrigerant circulation pipe 182 may be connected between the indoor unit mode controller 152 and the plurality of indoor units 162, 164, and 166. The refrigerant circulation pipe 182 may cause the refrigerant supplied to the plurality of indoor units 162, 164, and 166 from the indoor unit mode controller 152 to pass through each of the plurality of indoor units 162, 164, and 166 and then to return to the indoor unit mode controller 152.

The plurality of flow path switching apparatuses 132 and 142 may include apparatuses for selectively connecting the second refrigerant pipe 174 and the third refrigerant pipe 176 between the plurality of outdoor units 112 and 122 and the plurality of flow path switching apparatuses 132 and 142 according to an operation mode (e.g., modes such as single heating, single air-conditioning, main air-conditioning, main heating, and the like) required in the plurality of indoor units 162, 164, and 166. For example, the plurality of flow path switching apparatuses 132 and 142 may transmit a high-pressure compressed refrigerant supplied from both or one of the plurality of outdoor units 112 and 122 to the indoor unit mode controller 152 and may transmit a low-pressure refrigerant that passes through the indoor unit mode controller 152 from all or a part of the plurality of indoor units 162, 164, and 166 and that returns to the indoor unit mode controller 152, to both or one of the plurality of outdoor units 112 and 122. The indoor unit mode controller 152 may be a unit that controls the amount of the refrigerant supplied to each of the plurality of indoor units 162, 164, and 166 and obtains a degree of supercooling of the refrigerant. In this way, a flow path switching apparatus in accordance with an embodiment of the disclosure is additionally installed at an existing outdoor unit that has been already installed so that simultaneous air-conditioning/heating may be performed in an existing heat pump in which simultaneous air-conditioning/heating cannot be performed.

A place or destination to which a refrigerant in which state is transmitted from the plurality of flow path switching apparatuses 132 and 142, is determined according to an operation state of each of the plurality of outdoor units 112 and 122 and an operation mode required in each of the plurality of indoor units 162, 164, and 166. The plurality of flow path switching apparatuses 132 and 142 cause the heat pump in which a simultaneous air-conditioning/heating operation cannot be performed, to be used as a heat pump in which a simultaneous air-conditioning/heating operation may be performed, as illustrated in FIGS. 2 through 5 that will be described below.

An indoor heat exchanger and an electronic expansion valve may be disposed at each of the plurality of indoor units 162, 164, and 166. The indoor heat exchanger disposed at each of the plurality of indoor units 162, 164, and 166 operates as an evaporator in an air-conditioning operation mode and operates as a condenser in a heating operation mode. The electronic expansion valve disposed at each of the plurality of indoor units 162, 164, and 166 operates as a throttling unit by adjusting a valve opening degree in the air-conditioning operation mode, and the electronic expansion valve causes a high-temperature high-pressure gaseous refrigerant ejected from the first outdoor unit 112 or the second outdoor unit 122 to smoothly flow in the heating operation mode, because the valve opening degree is sufficient.

Figure 2:
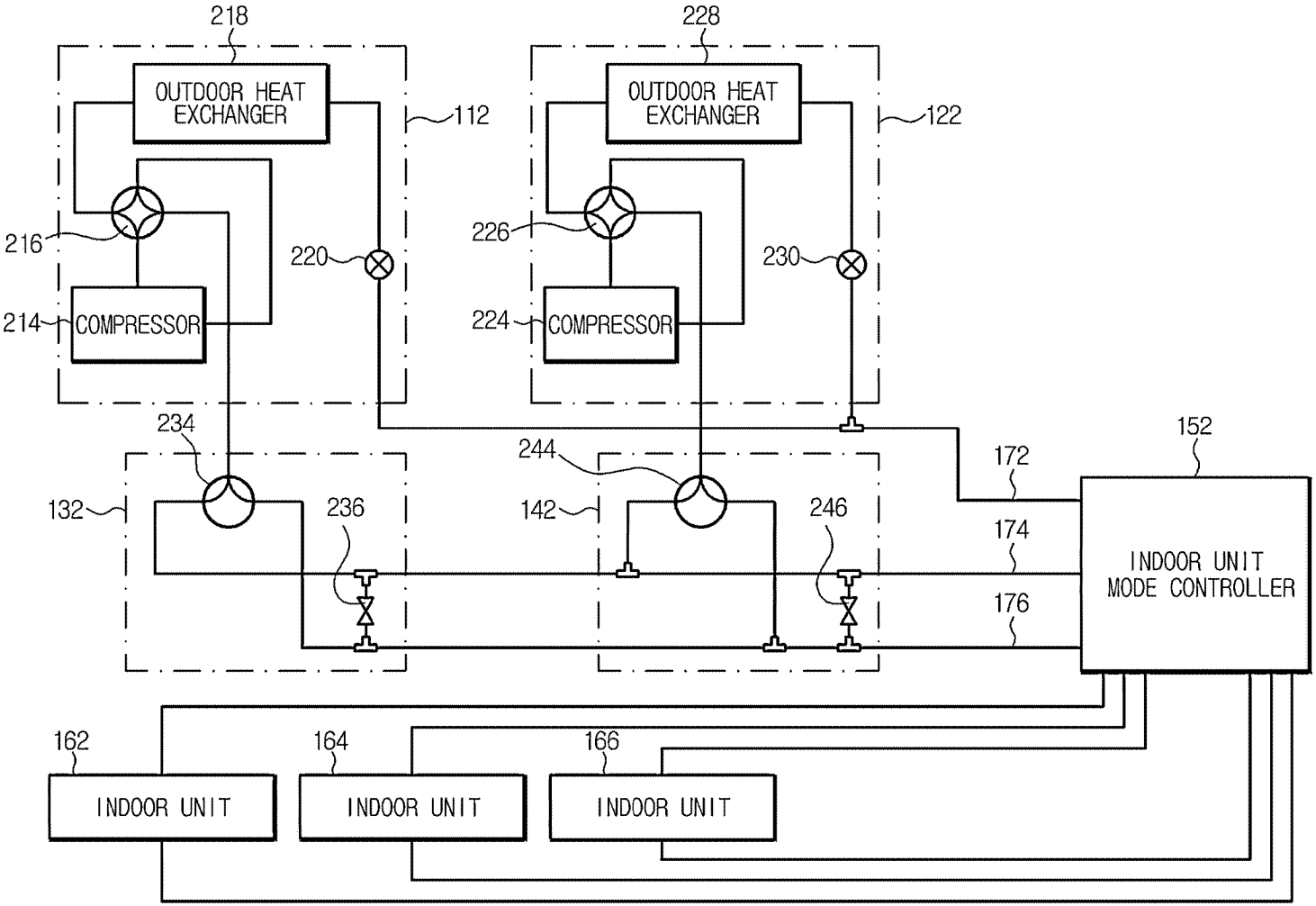
FIG. 2 illustrates a refrigerant cycle of the heat pump illustrated in FIG. 1.

FIG. 2 illustrates a refrigerant cycle of the heat pump illustrated in FIG. 1. The pipe connection relationship between the plurality of outdoor units 112 and 122, the plurality of flow path switching apparatuses 132 and 142, one indoor unit mode controller 152, and the plurality of indoor units 162, 164, and 166 is as previously described with reference to FIG. 1. In FIG. 2, an internal configuration or arrangement of each of the plurality of outdoor units 112 and 122 and each of the plurality of flow path switching apparatuses 132 and 142 will now be described.

In the first outdoor unit 112, a 4-way valve 216 may be connected between an ejection side and an inhalation (or intake) side of a compressor 214 via a pipe. The 4-way valve 216 connects the ejection (or discharge) side of the compressor 214 to one side of an outdoor heat exchanger 218 or the first flow path switching apparatus 132. The 4-way valve 216 also connects the inhalation side of the compressor 214 to one side of the outdoor heat exchanger 218 or the first flow path switching apparatus 132. Due to the action of the 4-way valve 216, the high-temperature and high-pressure gaseous refrigerant ejected from the compressor 214 may be transmitted to one of the outdoor heat exchanger 218 and the first flow path switching apparatus 132, and a low-pressure gaseous refrigerant transmitted from one of the outdoor heat exchanger 218 and the first flow path switching apparatus 132 may be transmitted to the inhalation side of the compressor 214. The first refrigerant pipe 172 may be connected to the other side of the outdoor heat exchanger 218, and an electronic expansion valve 220 may be installed on the way of the first refrigerant pipe 172 (e.g., between the other side of the outdoor heat exchanger 218 and the indoor unit mode controller 152). The electronic expansion valve 220 of the first outdoor unit 112 operates as a throttling unit that drops pressure of the refrigerant flowing into the outdoor heat exchanger 218 by adjusting a valve opening degree in the heating operation mode and causes the refrigerant condensed by the outdoor heat exchanger 218 to smoothly flow into the indoor unit mode controller 152 in the air-conditioning operation mode, because the valve opening degree is sufficient.

The second outdoor unit 122 also has a similar structure to that of the first outdoor unit 112. That is, in the second outdoor unit 122, a 4-way valve 226 may be connected between the ejection side and the inhalation side of a compressor 224 via a pipe. The 4-way valve 226 connects the ejection side of the compressor 224 to one side of an outdoor heat exchanger 228 or the second flow path switching apparatus 142 and connects the inhalation side of the compressor 224 to one side of the outdoor heat exchanger 228 or the second flow path switching apparatus 142. Due to the action of the 4-way valve 226, the high-pressure refrigerant ejected from the compressor 224 may be transmitted to one of the outdoor heat exchanger 228 and the second flow path switching apparatus 142, and the low-pressure refrigerant transmitted from one of the outdoor heat exchanger 228 and the second flow path switching apparatus 142 may be transmitted to the inhalation side of the compressor 224. The first refrigerant pipe 172 may be connected to the other side of the outdoor heat exchanger 228, and an electronic expansion valve 230 may be installed on the way of the first refrigerant pipe 172. The electronic expansion valve 230 of the second outdoor unit 122 operates as a throttling unit that drops the pressure of the refrigerant flowing into the outdoor heat exchanger 228 by adjusting the valve opening degree in the heating operation mode and causes the refrigerant condensed by the outdoor heat exchanger 228 to smoothly flow into the indoor unit mode controller 152 in the air-conditioning operation mode, because the valve opening degree is sufficient.

The first flow path switching apparatus 132 may include of a 3-way valve 234 and a bypass valve 236. The 3-way valve 234 causes one of the second refrigerant pipe 174 and the third refrigerant pipe 176 to be connected to a 4-way valve 216 of the first outdoor unit 112. In other words, the first flow path switching apparatus 132 causes a gas pipe connected to the 4-way valve 216 of the first outdoor unit 112 to diverge into one of the second refrigerant pipe 174 and the third refrigerant pipe 176 and to reach the indoor unit mode controller 152. Within the first flow path switching apparatus 132, the bypass valve 236 may be installed between the second refrigerant pipe 174 and the third refrigerant pipe 176. The bypass valve 236 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 176, so that the section can be used as a refrigerant flow path.

The configuration or arrangement of the second flow path switching apparatus 142 is also similar to that of the first flow path switching apparatus 132. That is, the second flow path switching apparatus 142 may include a 3-way valve 244 and a bypass valve 246. The 3-way valve 244 causes one of the second refrigerant pipe 174 and the third refrigerant pipe 176 to be connected to the 4-way valve 226 of the second outdoor unit 122. In other words, the second flow path switching apparatus 142 causes the gas pipe connected to the 4-way valve 226 of the second outdoor unit 122 to diverge into one of the second refrigerant pipe 174 and the third refrigerant pipe 176 and to reach the indoor unit mode controller 152. Within the second flow path switching apparatus 142, the bypass valve 246 may be installed between the second refrigerant pipe 174 and the third refrigerant pipe 176. The bypass valve 246 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 176, so that the section can be used as a refrigerant flow path.

The first flow path switching apparatus 132 and the second flow path switching apparatus 142 switch the refrigerant flow path between the plurality of outdoor units 112 and 122 and the indoor unit mode controller 152 so that an air-conditioning/heating operation required in each of the plurality of indoor units 162, 164, and 166 can be performed, in consideration of an air-conditioning/heating operation required in the plurality of indoor units 162, 164, and 166 and an air-conditioning/heating operation state of each of the plurality of outdoor units 112 and 122. A refrigerant flow path switching operation of the plurality of flow path switching apparatuses 132 and 142 will now be described with reference to FIGS. 3 through 5.

Figure 3:
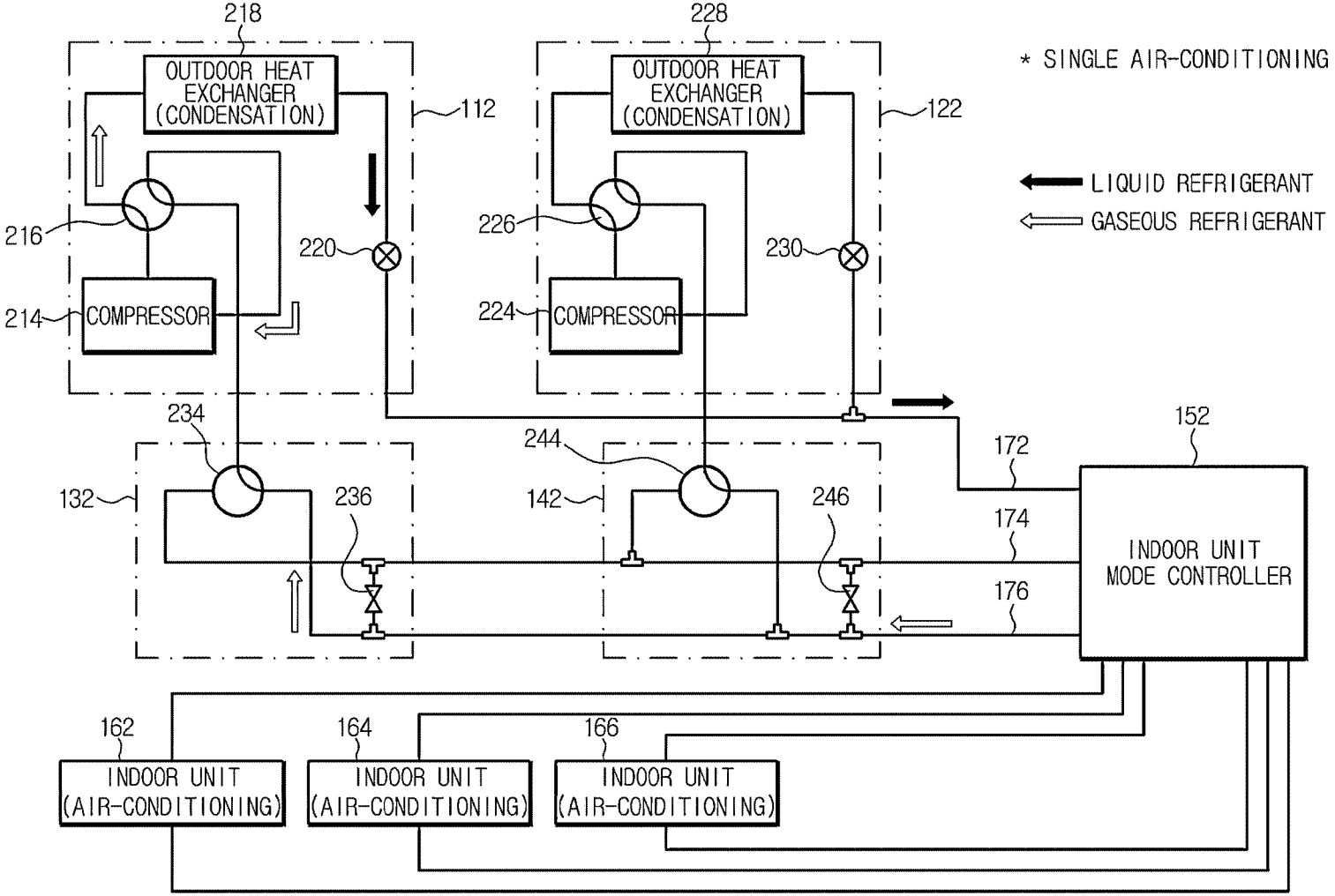
FIG. 3 illustrates a single air-conditioning mode of the heat pump illustrated in FIG. 2.

FIG. 3 illustrates a single air-conditioning mode of the heat pump illustrated in FIG. 2. As illustrated in FIG. 3, as an air-conditioning operation is required in all of the plurality of indoor units 162, 164, and 166, the plurality of indoor units 162, 164, and 166 operate in an air-conditioning operation mode, and indoor heat exchangers of each of the plurality of indoor units 162, 164, and 166 operate as evaporators for air-conditioning. Also, the plurality of outdoor units 112 and 122 also operate in the air-conditioning operation mode, and outdoor heat exchangers 218 and 228 of each of the plurality of outdoor units 112 and 122 operate as condensers.

First, with respect to the first outdoor unit 112, in regard to a flow path switching state of the 4-way valve 216, a refrigerant flow path is formed between the ejection side of the compressor 214 and one side of the outdoor heat exchanger 218, and a refrigerant flow path is formed between the inhalation side of the compressor 214 and the 3-way valve 234 of the first flow path switching apparatus 132. In the 3-way valve 234 of the first flow path switching apparatus 132, no refrigerant flow path is formed by the second refrigerant pipe 174, and a refrigerant flow path is formed only by the third refrigerant pipe 176. By switching the flow path of the 4-way valve 216 of the first outdoor unit 112 and the 3-way valve 234 of the first flow path switching apparatus 132 in this way, a high-temperature high-pressure gaseous refrigerant ejected from the compressor 214 is condensed by the outdoor heat exchanger 218 and is liquefied and then flows into the indoor unit mode controller 152 through the first refrigerant pipe 172. The indoor unit mode controller 152 supplies the liquid refrigerant flowing from the first outdoor unit 112 to each of the plurality of indoor units 162, 164, and 166 so that air-conditioning can be performed in all of the plurality of indoor units 162, 164, and 166. Air-conditioning in each of the plurality of indoor units 162, 164, and 166 may be performed by heat-exchange between the refrigerant, the temperature of which is lowered due to evaporation of the liquid refrigerant caused by a throttling action, and the indoor air. The low-pressure gaseous refrigerant that contributes to air-conditioning due to evaporation in the plurality of indoor units 162, 164, and 166 flows into the indoor unit mode controller 152 and then flows into the first flow path switching apparatus 132 through the third refrigerant pipe 176 and flows into the inhalation side of the compressor 214 of the first outdoor unit 112 through the 3-way valve 234 of the first flow path switching apparatus 132. As a result, one-cycle refrigerant circulation passing through the first outdoor unit 112 and the first flow path switching apparatus 132 in the air-conditioning operation mode is completed.

Next, with respect to the second outdoor unit 122, in regard to the flow path switching state of the 4-way valve 226, a refrigerant flow path is formed between an ejection side of a compressor 224 and one side of an outdoor heat exchanger 228, and a refrigerant flow path is formed between an inhalation side of the compressor 224 and a 3-way valve 244 of the second flow path switching apparatus 142. In the 3-way valve 244 of the second flow path switching apparatus 142, no refrigerant flow path is formed by the second refrigerant pipe 174, and a refrigerant flow path is formed only by the third refrigerant pipe 176. By switching the flow path of the 4-way valve 226 of the second outdoor unit 122 and the 3-way valve 244 of the second flow path switching apparatus 142 in this way, a high-temperature high-pressure gaseous refrigerant ejected from the compressor 224 is condensed by the outdoor heat exchanger 228 and is liquefied and then flows into the indoor unit mode controller 152 through the first refrigerant pipe 172. The indoor unit mode controller 152 supplies the liquid refrigerant flowing from the second outdoor unit 122 to each of the plurality of indoor units 162, 164, and 166 so that air-conditioning can be performed in all of the plurality of indoor units 162, 164, and 166. Air-conditioning in each of the plurality of indoor units 162, 164, and 166 is performed by heat-exchange between the refrigerant, the temperature of which is lowered due to evaporation of the liquid refrigerant caused by a throttling action, and the indoor air. The low-pressure gaseous refrigerant that contributes to air-conditioning due to evaporation in the plurality of indoor units 162, 164, and 166 flows into the indoor unit mode controller 152 and then flows into the second flow path switching apparatus 142 through the third refrigerant pipe 176 and flows into the inhalation side of the compressor 224 of the second outdoor unit 122 through the 3-way valve 244 of the second flow path switching apparatus 142. As a result, one-cycle refrigerant circulation for a single air-conditioning operation passing through the second outdoor unit 122 and the second flow path switching apparatus 142 in the air-conditioning operation mode is completed.

Figure 4:
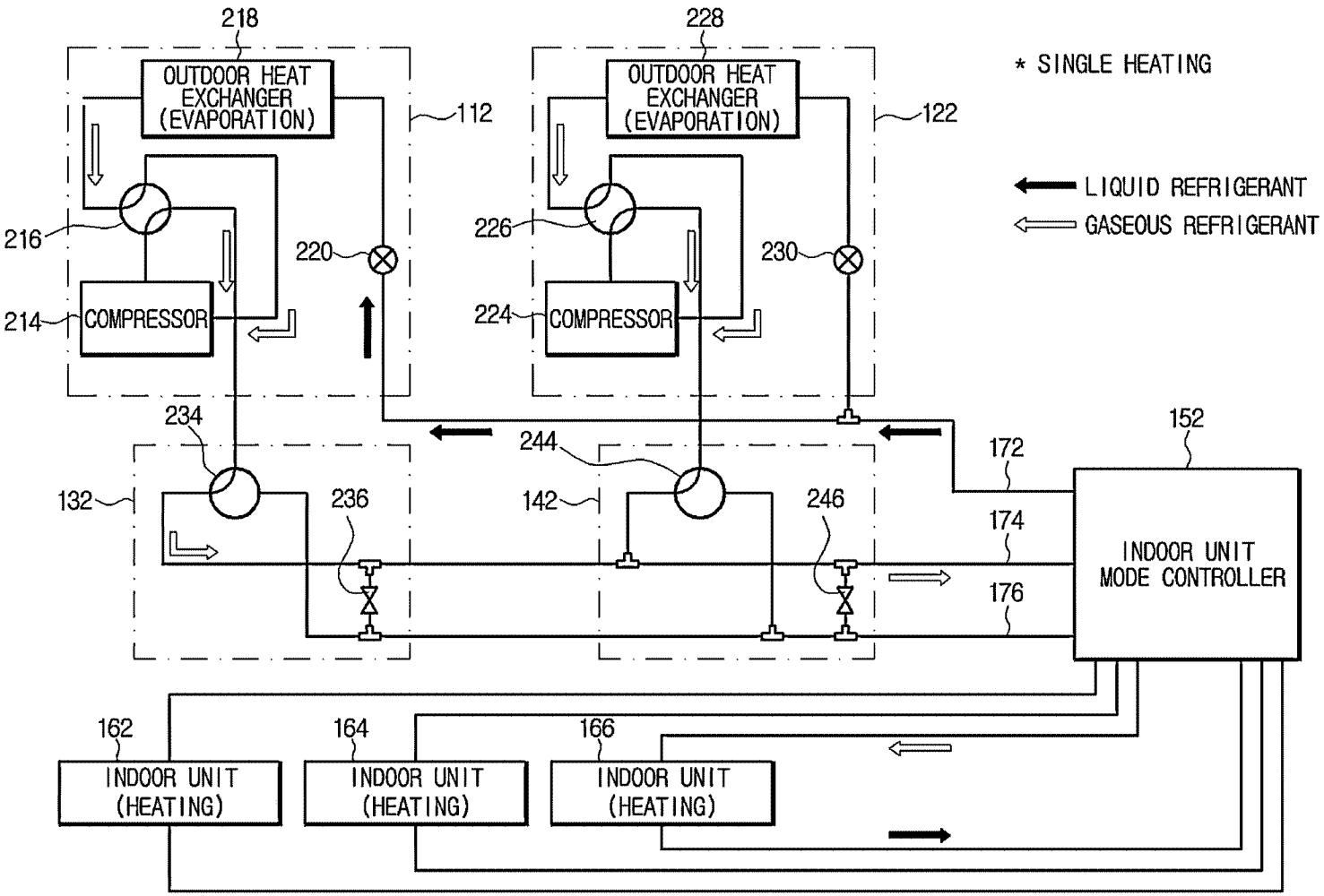
FIG. 4 illustrates a single heating mode of the heat pump of FIG. 2.

FIG. 4 illustrates a single heating mode of the heat pump of FIG. 2. As illustrated in FIG. 4, as a heating operation is required in all of the plurality of indoor units 162, 164, and 166, the plurality of indoor units 162, 164, and 166 operate in a heating operation mode, and indoor heat exchangers of each of the plurality of indoor units 162, 164, and 166 operate as condensers for heating. Also, the plurality of outdoor units 112 and 122 also operate in the heating operation mode, and outdoor heat exchangers 218 and 228 of each of the plurality of outdoor units 112 and 122 operate as evaporators.

First, with respect to the first outdoor unit 112, in regard to a flow path switching state of the 4-way valve 216, a refrigerant flow path is formed between the ejection side of the compressor 214 and the 3-way valve 234 of the first flow path switching apparatus 132, and a refrigerant flow path is formed between the inhalation side of the compressor 214 and one side of the outdoor heat exchanger 218. In the 3-way valve 234 of the first flow path switching apparatus 132, no refrigerant flow path is formed by the third refrigerant pipe 176, and a refrigerant flow path is formed only by the second refrigerant pipe 174. By switching the flow path of the 4-way valve 216 of the first outdoor unit 112 and the 3-way valve 234 of the first flow path switching apparatus 132 in this way, a high-temperature high-pressure gaseous refrigerant ejected from the compressor 214 flows into the indoor unit mode controller 152 through the first flow path switching apparatus 132. The indoor unit mode controller 152 supplies the high-temperature gaseous refrigerant flowing from the first outdoor unit 112 to each of the plurality of indoor units 162, 164, and 166 so that heating can be performed in all of the plurality of indoor units 162, 164, and 166. Heating in each of the plurality of indoor units 162, 164, and 166 is performed by heat-exchange between the high-temperature gaseous refrigerant and the indoor air. A liquid refrigerant liquefied while contributing to heating in the plurality of indoor units 162, 164, and 166 flows into the indoor unit mode controller 152 and then flows into the first outdoor unit 112 through the first refrigerant pipe 172. The liquid refrigerant flowing into the first outdoor unit 112 is throttled by the electronic expansion valve 220 of the first outdoor unit 112, passes through the outdoor heat exchanger 218 of the first outdoor unit 112, and is gasified, and then flows into the inhalation side of the compressor 214. As a result, one-cycle refrigerant circulation passing through the first outdoor unit 112 and the first flow path switching apparatus 132 in the heating operation mode is completed.

Next, with respect to the second outdoor unit 122, in regard to the flow path switching state of the 4-way valve 226, a refrigerant flow path is formed between an ejection side of a compressor 224 and the 3-way valve 244 of the second flow path switching apparatus 142, and a refrigerant flow path is formed between the inhalation side of the compressor 224 and one side of the outdoor heat exchanger 228. In the 3-way valve 244 of the second flow path switching apparatus 142, no refrigerant flow path is formed by the third refrigerant pipe 176, and a refrigerant flow path is formed only by the second refrigerant pipe 174. By switching the flow path of the 4-way valve 226 of the second outdoor unit 122 and the 3-way valve 244 of the second flow path switching apparatus 142 in this way, a high-temperature high-pressure gaseous refrigerant ejected from the compressor 224 flows into the indoor unit mode controller 152 through the second flow path switching apparatus 142. The indoor unit mode controller 152 supplies the high-temperature gaseous refrigerant flowing from the second outdoor unit 122 to each of the plurality of indoor units 162, 164, and 166 so that heating can be performed in all of the plurality of indoor units 162, 164, and 166. Heating in each of the plurality of indoor units 162, 164, and 166 is performed by heat-exchange between the high-temperature gaseous refrigerant and the indoor air. The liquid refrigerant liquefied while contributing to heating in the plurality of indoor units 162, 164, and 166 flows into the indoor unit mode controller 152 and then flows into the second outdoor unit 122 through the first refrigerant pipe 172. The liquid refrigerant flowing into the second outdoor unit 122 is throttled by the electronic expansion valve 230 of the second outdoor unit 122, passes through the outdoor heat exchanger 228 of the second outdoor unit 122, and is gasified, and then flows into the inhalation side of the compressor 224. As a result, one-cycle refrigerant circulation passing through the second outdoor unit 122 and the second flow path switching apparatus 142 in the heating operation mode is completed.

Figure 5:
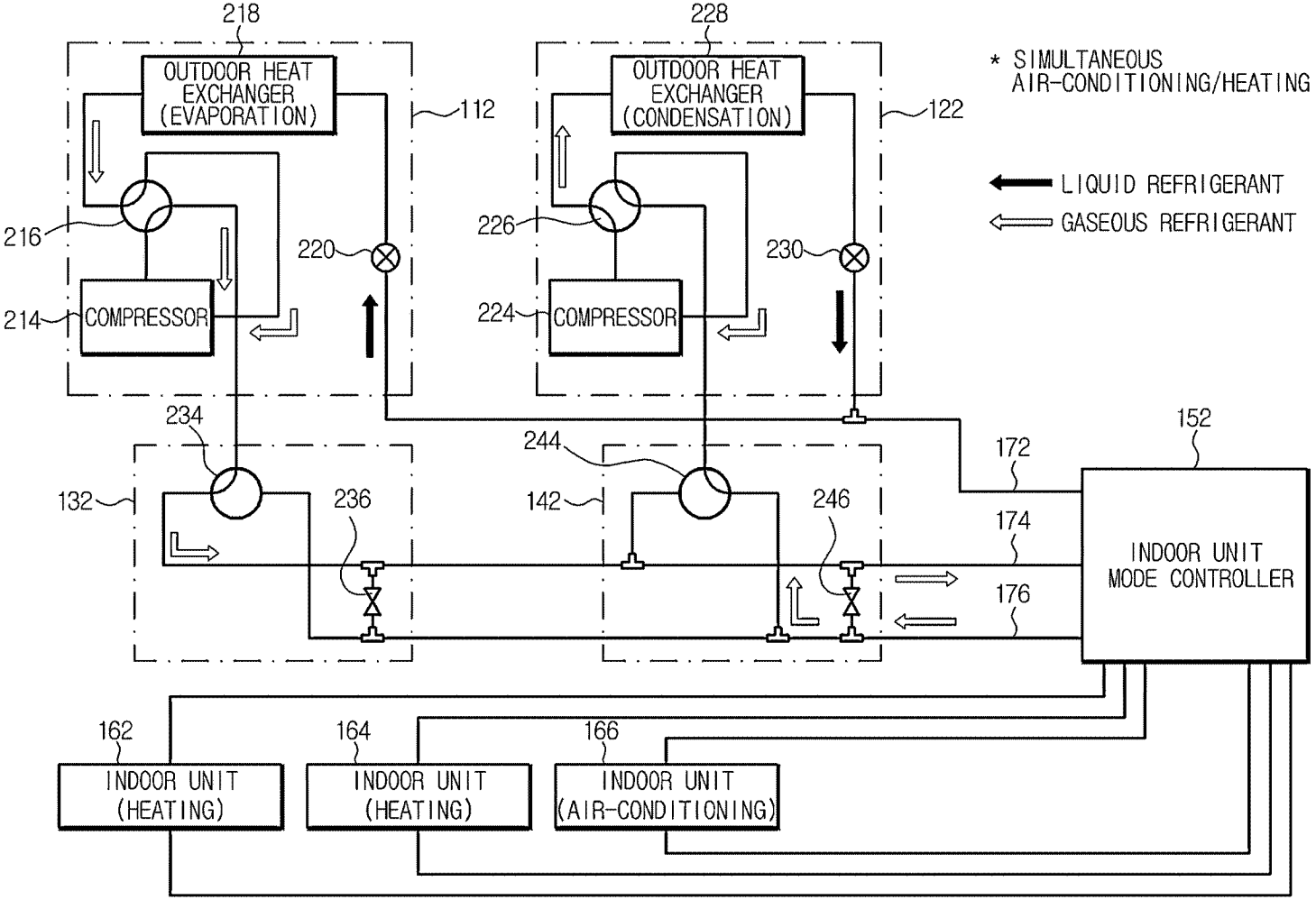
FIG. 5 illustrates a simultaneous air-conditioning and heating mode of the heat pump of FIG. 2.

FIG. 5 illustrates a simultaneous air-conditioning and heating mode of the heat pump of FIG. 2. As illustrated in FIG. 5, a heating operation is required in the first indoor unit 162 and the second indoor unit 164 from among the plurality of indoor units 162, 164, and 166 and an air-conditioning operation is required in the third indoor unit 166. The first indoor unit 162 and the second indoor unit 164 from among the plurality of indoor units 162, 164, and 166 operate in a heating operation mode, and the third indoor unit 166 operates in an air-conditioning operation mode. Thus, indoor heat exchangers of the first indoor unit 162 and the second indoor unit 164 from among the plurality of indoor units 162, 164, and 166 operate as condensers for heating, and an indoor heat exchanger of the third indoor unit 166 operates as an evaporator for an air-conditioning operation. Also, the first outdoor unit 112 from among the plurality of outdoor units 112 and 122 operates in the heating operation mode, and the second outdoor unit 122 operates in the air-conditioning mode. Thus, an outdoor heat exchanger 218 of the first indoor unit 162 from among the plurality of outdoor units 112 and 122 operates as an evaporator, and an outdoor heat exchanger 228 of the second outdoor unit 122 operates as a condenser.

First, with respect to the first outdoor unit 112 that operates in the heating operation mode, in regard to a flow path switching state of a 4-way valve 216, a refrigerant flow path is formed between the ejection side of the compressor 214 and the 3-way valve 234 of the first flow path switching apparatus 132, and a refrigerant flow path is formed between the inhalation side of the compressor 214 and one side of the outdoor heat exchanger 218. In the 3-way valve 234 of the first flow path switching apparatus 132, no refrigerant flow path is formed by the third refrigerant pipe 176, and a refrigerant flow path is formed only by the second refrigerant pipe 174. By switching the flow path of the 4-way valve 216 of the first outdoor unit 112 and the 3-way valve 234 of the first flow path switching apparatus 132 in this way, a high-temperature high-pressure gaseous refrigerant ejected from the compressor 214 flows into the indoor unit mode controller 152 through the first flow path switching apparatus 132. The indoor unit mode controller 152 supplies the high-temperature gaseous refrigerant flowing from the first outdoor unit 112 to the first indoor unit 162 and the second indoor unit 164 that operate in the heating operation mode so that heating can be performed in the first indoor unit 162 and the second indoor unit 164. Heating in the first indoor unit 162 and the second indoor unit 164 is performed by heat-exchange between the high-temperature gaseous refrigerant and the indoor air. A liquid refrigerant liquefied while contributing to heating in the first indoor unit 162 and the second indoor unit 164 flows into the indoor unit mode controller 152, flows into the first outdoor unit 112 through the first refrigerant pipe 172. The liquid refrigerant flowing into the first outdoor unit 112 is throttled by the electronic expansion valve 220 of the first outdoor unit 112, passes through the outdoor heat exchanger 218 of the first outdoor unit 112, and is gasified, and then flows into the inhalation side of the compressor 214. As a result, one-cycle refrigerant circulation passing through the first outdoor unit 112 and the first flow path switching apparatus 132 in the heating operation mode in the first indoor unit 162 and the second indoor unit 164 is completed.

Next, with respect to the second outdoor unit 122 that operates in the air-conditioning operation mode, in regard to the flow path switching state of the 4-way valve 226, a refrigerant flow path is formed between the ejection side of a compressor 224 and one side of the outdoor heat exchanger 228, and a refrigerant flow path is formed between the inhalation side of the compressor 224 and the 3-way valve 244 of the second flow path switching apparatus 142. In the 3-way valve 244 of the second flow path switching apparatus 142, no refrigerant flow path is formed by the second refrigerant pipe 174, and a refrigerant flow path is formed only by the third refrigerant pipe 176. By switching the flow path of the 4-way valve 226 of the second outdoor unit 122 and the 3-way valve 244 of the second flow path switching apparatus 142 in this way, a high-temperature high-pressure gaseous refrigerant ejected from the compressor 224 passes through the outdoor heat exchanger 228, is condensed and liquefied, and then flows into the indoor unit mode controller 152 through the first refrigerant pipe 172. The indoor unit mode controller 152 supplies the liquid refrigerant flowing from the second outdoor unit 122 to the third indoor unit 166 so that air-conditioning can be performed in the third indoor unit 166. Air-conditioning in the third indoor unit 166 may be performed by heat-exchange between the refrigerant, the temperature of which is lowered by evaporation of the liquid refrigerant due to a throttling action, and the indoor air. A low-pressure gaseous refrigerant that contributes to air-conditioning through evaporation in the third indoor unit 166 flows into the indoor unit mode controller 152, flows into the second flow path switching apparatus 142 through the third refrigerant pipe 176, and then flows into the inhalation side of the compressor 224 of the second outdoor unit 122 through the 3-way valve 244 of the second flow path switching apparatus 142. As a result, one-cycle refrigerant circulation passing through the second outdoor unit 122 and the second flow path switching apparatus 142 for the air-conditioning operation mode of the third indoor unit 166 is completed.

Figure 6:
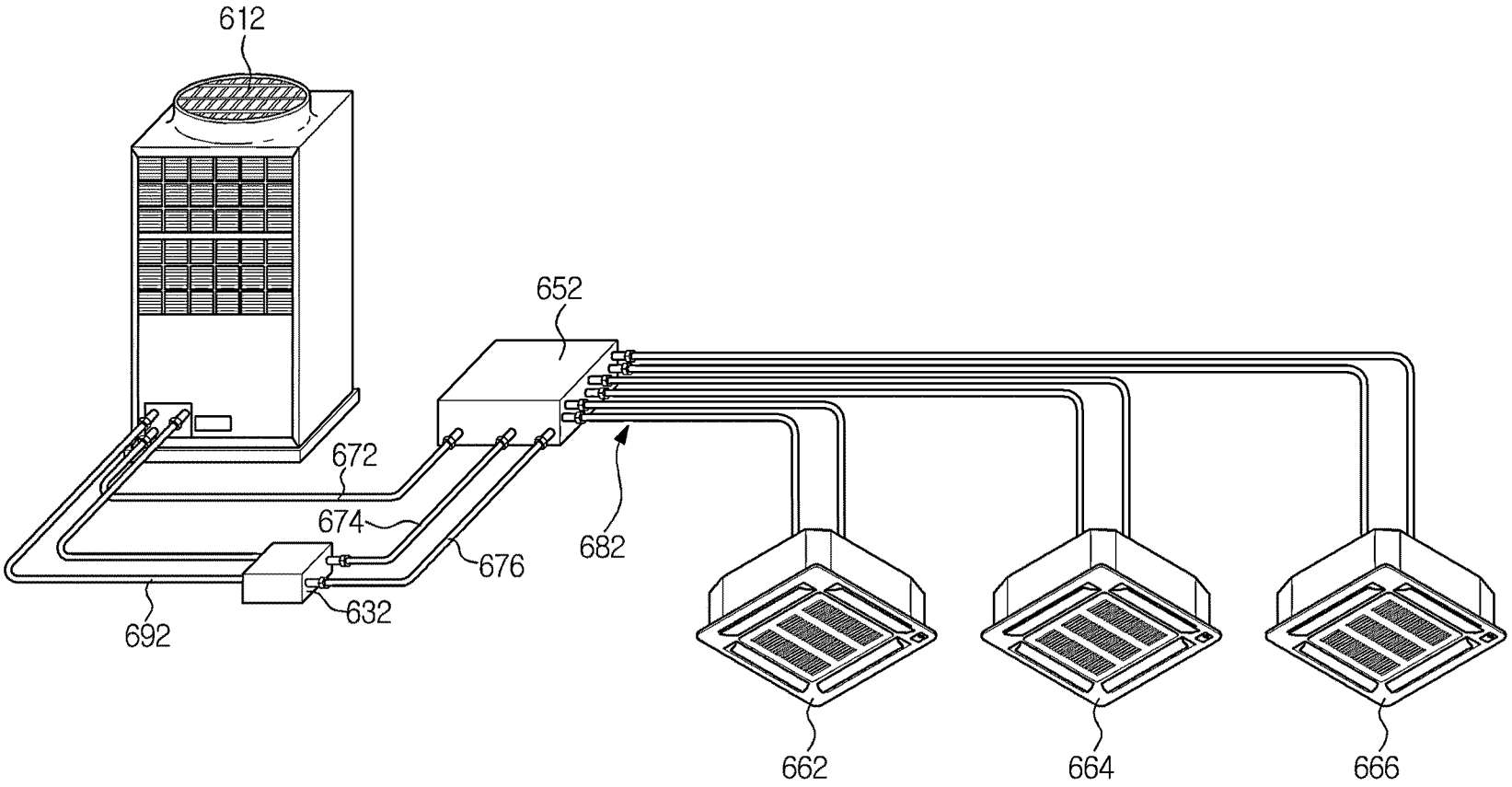
FIG. 6 illustrates a heat pump in accordance with an embodiment of the disclosure.

FIG. 6 illustrates a heat pump in accordance with an embodiment of the disclosure. The heat pump illustrated in FIG. 6 in accordance with an embodiment of the disclosure includes one outdoor unit 612 and one flow path switching apparatus 632, one indoor unit mode controller 652, and a plurality of indoor units, for example, a first indoor unit 662, a second indoor unit 664, and a third indoor unit 666, wherein these elements may be connected to one another via refrigerant circulation pipes and a refrigerant cycle may be configured or arranged by this connection.

A plurality of refrigerant pipes, for example, a first refrigerant pipe 672, a second refrigerant pipe 674, and a third refrigerant pipe 676 may be connected between the indoor unit mode controller 652 and the outdoor unit 612. Here, the first refrigerant pipe 672 may be a liquid pipe through which a liquid refrigerant flows, the second refrigerant pipe 674 may be a high-pressure gas pipe through which a high-pressure gaseous refrigerant flows, and the third refrigerant pipe 676 may be a low-pressure gas pipe through which a low-pressure gaseous refrigerant flows. The first refrigerant pipe 672 may be directly connected to the outdoor unit 612 from the indoor unit mode controller 652. The second refrigerant pipe 674 and the third refrigerant pipe 676 may be connected to the outdoor unit 612 via the flow path switching apparatus 632. That is, the first flow path switching apparatus 632 switches a refrigerant flow path so that the refrigerant flows between the outdoor unit 612 and the indoor unit mode controller 652 via one of the second refrigerant pipe 674 and the third refrigerant pipe 676. A refrigerant circulation pipe 682 may be connected between the indoor unit mode controller 652 and the plurality of indoor units 662, 664, and 666. The refrigerant circulation pipe 682 causes the refrigerant supplied to the plurality of indoor units 662, 664, and 666 from the indoor unit mode controller 652 to pass through each of the plurality of indoor units 662, 664, and 666 and then to return to the indoor unit mode controller 652.

The flow path switching apparatus 632 may be an apparatus for selectively connecting the second refrigerant pipe 674 and the third refrigerant pipe 676 between the outdoor unit 612 and the plurality of indoor units 662, 664, and 666 according to an operation mode (e.g., single heating, single air-conditioning, main air-conditioning, and main heating) required in the plurality of indoor units 662, 664, and 666. For example, the flow path switching apparatus 632 may transmit a high-pressure compressed refrigerant supplied from the outdoor unit 612 to the indoor unit mode controller 652 and transmit a low-pressure refrigerant that passes through the indoor unit mode controller 652 from all or a part of the plurality of indoor units 662, 664, and 666 and returns to the indoor unit mode controller 652 to the outdoor unit 612. The indoor unit mode controller 652 may be a unit that controls the amount of the refrigerant supplied to each of the plurality of indoor units 662, 664, and 666 and obtains a degree of supercooling of the refrigerant. A refrigerant branching pipe 692 may be further connected between the flow path switching apparatus 632 and the outdoor unit 612. The refrigerant branching pipe 692 will be described in detail with reference to FIG. 7. In this way, a flow path switching apparatus in accordance with an embodiment of the disclosure is additionally installed at an existing outdoor unit that has been already installed so that simultaneous air-conditioning/heating can be performed in an existing heat pump in which simultaneous air-conditioning/heating cannot be performed.

A place or destination to which a refrigerant is transmitted from the flow path switching apparatus 632, and a state of the refrigerant, may be determined according to an operation state of the outdoor unit 612 and an operation mode required in each of the plurality of indoor units 662, 664, and 666. The flow path switching apparatus 632 causes the heat pump in which a simultaneous air-conditioning/heating operation cannot be performed, to be used as a heat pump in which a simultaneous air-conditioning/heating operation can be performed, as illustrated in FIGS. 7 through 11 that will be described below.

An indoor heat exchanger and an electronic expansion valve may be disposed at each of the plurality of indoor units 662, 664, and 666. The indoor heat exchanger disposed at each of the plurality of indoor units 662, 664, and 666 operates as an evaporator in an air-conditioning operation mode and operates as a condenser in a heating operation mode. The electronic expansion valve disposed at each of the plurality of indoor units 662, 664, and 666 operates as a throttling unit by adjusting a valve opening degree in the heating operation mode, and the electronic expansion valve causes a high-temperature high-pressure gaseous refrigerant ejected from the outdoor unit 612 to smoothly flow in the heating operation mode, because the valve opening degree is sufficient. The electronic expansion valve disposed at each of the plurality of indoor units 662, 664, and 666 operates causes the refrigerant condensed by the outdoor heat exchanger 718 to smoothly flow in the air conditioning operation mode by adjusting a valve opening degree such that the valve opening degree is sufficient.

Figure 7:
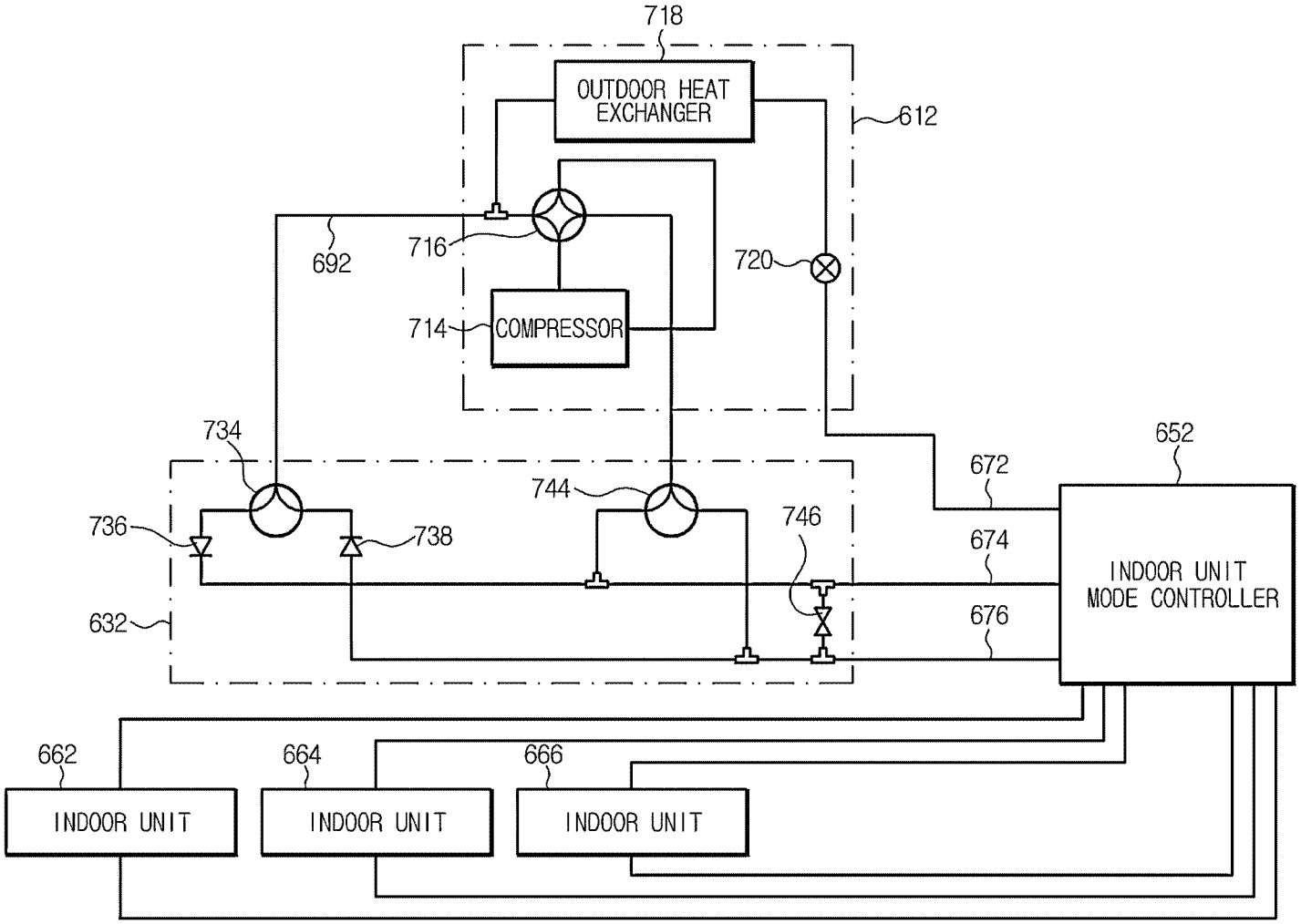
FIG. 7 illustrates a refrigerant cycle of the heat pump illustrated in FIG. 6.

FIG. 7 illustrates a refrigerant cycle of the heat pump illustrated in FIG. 6. The pipe connection relationship between one outdoor unit 612, one flow path switching apparatus 632, one indoor unit mode controller 652, and the plurality of indoor units 662, 664, and 666 is as previously described with reference to FIG. 6. In FIG. 7, an internal configuration or arrangement of the one outdoor unit 612 and the one flow path switching apparatus 632 will now be described.

In the outdoor unit 612, a 4-way valve 716 is connected between an ejection side and an inhalation side of a compressor 714 via a pipe. The 4-way valve 716 connects the ejection side of the compressor 714 to one side of an outdoor heat exchanger 718 or the flow path switching apparatus 632 and connects the inhalation side of the compressor 714 to one side of the outdoor heat exchanger 718 or the flow path switching apparatus 632. Due to the action of the 4-way valve 716, a high-pressure refrigerant ejected from the compressor 714 may be transmitted to one of the outdoor heat exchanger 718 and the flow path switching apparatus 632, and a low-pressure refrigerant transmitted from one of the outdoor heat exchanger 718 and the flow path switching apparatus 632 may be transmitted to the inhalation side of the compressor 714. The first refrigerant pipe 672 may be connected to the other side of the outdoor heat exchanger 718, and an electronic expansion valve 720 may be installed on the way of the first refrigerant pipe 672. The electronic expansion valve 720 of the outdoor unit 612 operates as a throttling unit that drops pressure of the refrigerant flowing into the outdoor heat exchanger 718 by adjusting the valve opening degree in the heating operation mode and causes the refrigerant condensed by the outdoor heat exchanger 718 to smoothly flow into the indoor unit mode controller 652 in the air-conditioning operation mode, because the valve opening degree is sufficient.

The flow path switching apparatus 632 may include a plurality of 3-way valves, for example, a first 3-way valve 734 and a second 3-way valve 744, a plurality of check valves, for example, a first check valve 736 and a second check valve 738, and one bypass valve 746. The refrigerant branching pipe 692 may be a refrigerant pipe that branches from a place where the 4-way valve 716 and one side of the outdoor heat exchanger 718 are connected to each other and that is connected to the first 3-way valve 734 of the flow path switching apparatus 632. The first 3-way valve 734 causes one of the second refrigerant pipe 674 and the third refrigerant pipe 676 to be connected to the 4-way valve 716 of the outdoor unit 612 via the refrigerant branching pipe 692. In other words, the flow path switching apparatus 632 causes the refrigerant branching pipe 692 that branches between the 4-way valve 716 of the outdoor unit 612 and the outdoor heat exchanger 718 to diverge into one of the second refrigerant pipe 674 and the third refrigerant pipe 676 and to reach the indoor unit mode controller 652. In the flow path switching apparatus 632, the first check valve 736 that forcibly induces the flow of the refrigerant in a direction of the indoor unit mode controller 652 from the first 3-way valve 734 may be installed on the second refrigerant pipe 674 connected to the first 3-way valve 734. Also, within the flow path switching apparatus 632, the second check valve 738 that forcibly induces the flow of the refrigerant in a direction of the first 3-way valve 734 from the indoor unit mode controller 652 may be installed on the third refrigerant pipe 676 connected to the first 3-way valve 734. The second 3-way valve 744 causes one of the second refrigerant pipe 674 and the third refrigerant pipe 676 to be connected to the 4-way valve 716 of the outdoor unit 612. In other words, the flow path switching apparatus 632 causes the refrigerant pipe connected to the 4-way valve 716 of the outdoor unit 612 to diverge into one of the second refrigerant pipe 674 and the third refrigerant pipe 676 and to reach the indoor unit mode controller 652. Within the flow path switching apparatus 632, the bypass valve 746 may be installed between the second refrigerant pipe 674 and the third refrigerant pipe 676. In particular, the bypass valve 746 may be installed between a place where the second 3-way valve 744 is connected to the second refrigerant pipe 674 and the third refrigerant pipe 676 and the indoor unit mode controller 652. The bypass valve 746 causes pressure inside the second refrigerant pipe 674 and pressure inside the third refrigerant pipe 676 to be equalized or the refrigerant to flow in a partial section that is not used by one of the second refrigerant pipe 674 and the third refrigerant pipe 676, so that the section can be used as a refrigerant flow path (see the description of FIG. 8).

The flow path switching apparatus 632 may switch the refrigerant flow path between the outdoor unit 612 and the indoor unit mode controller 652 so that an air-conditioning/heating operation required in each of the plurality of indoor units 662, 664, and 666 can be performed, in consideration of an air-conditioning/heating operation required in the plurality of indoor units 662, 664, and 666 and an air-conditioning/heating operation state of the outdoor unit 612. A refrigerant flow path switching operation of the flow path switching apparatus 632 will now be described with reference to FIGS. 8 through 11.

Figure 8:
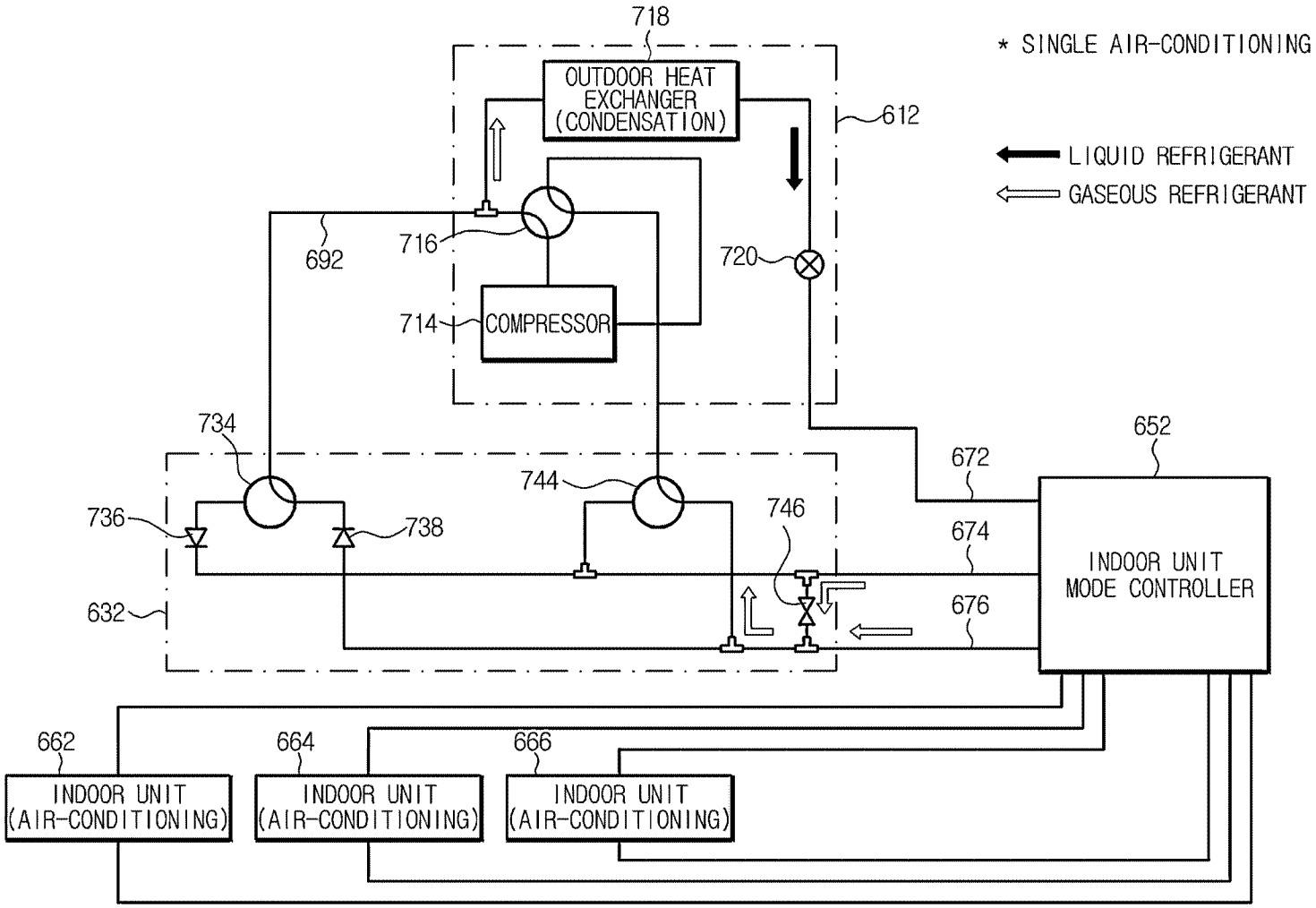
FIG. 8 illustrates a single air-conditioning mode of the heat pump illustrated in FIG. 7.

FIG. 8 illustrates a single air-conditioning mode of the heat pump illustrated in FIG. 7. As illustrated in FIG. 8, as an air-conditioning operation is required in all of the plurality of indoor units 662, 664, and 666, the plurality of indoor units 662, 664, and 666 operate in an air-conditioning operation mode, and indoor heat exchangers of each of the plurality of indoor units 662, 664, and 666 operate as evaporators for air-conditioning. Also, the outdoor unit 612 also operates in the air-conditioning operation mode, and the outdoor heat exchanger 718 of the outdoor unit 612 operates as a condenser.

With respect to the outdoor unit 612, in regard to a flow path switching state of the 4-way valve 716, a refrigerant flow path is formed between the ejection side of the compressor 714 and one side of the outdoor heat exchanger 718. Due to the formation of the refrigerant flow path, a refrigerant flow path is formed between the ejection side of the compressor 714 and the first 3-way valve 734 of the flow path switching apparatus 632 through the refrigerant branching pipe 692. Here, the second check valve 738 may be closed so that the refrigerant ejected from the compressor 714 does not flow into the flow path switching apparatus 632 through the refrigerant branching pipe 692, but instead flows into one side of the outdoor heat exchanger 718. Also, due to the 4-way valve 716 of the outdoor unit 612, a refrigerant flow path is formed between the inhalation side of the compressor 714 and the second 3-way valve 744 of the flow path switching apparatus 632. The first 3-way valve 734 of the flow path switching apparatus 632 does not constitute a refrigerant flow path through the second refrigerant pipe 674 and constitutes a refrigerant flow path only through the third refrigerant pipe 676. The second 3-way valve 744 of the flow path switching apparatus 632 does not constitute a refrigerant flow path through the second refrigerant pipe 674 and constitutes a refrigerant flow path only through the third refrigerant pipe 676. By switching the flow path of the 4-way valve 716 of the outdoor unit 612 and the first 3-way valve 734 of the flow path switching apparatus 632 in this way, a high-temperature high-pressure gaseous refrigerant ejected from the compressor 714 is condensed by the outdoor heat exchanger 718 and is liquefied via a condensation operation, and then flows into the indoor unit mode controller 652 through the second refrigerant pipe 672. The indoor unit mode controller 652 supplies the liquid refrigerant flowing from the outdoor unit 612 to each of the plurality of indoor units 662, 664, and 666 so that air-conditioning can be performed in all of the plurality of indoor units 662, 664, and 666. Air-conditioning in each of the plurality of indoor units 662, 664, and 666 is performed by heat-exchange between the refrigerant, the temperature of which is lowered due to evaporation of the liquid refrigerant caused by a throttling action, and the indoor air. The low-pressure gaseous refrigerant that contributes to air-conditioning due to evaporation in the plurality of indoor units 662, 664, and 666 flows into the indoor unit mode controller 652 and then flows into the flow path switching apparatus 632 through the third refrigerant pipe 676 and flows into the inhalation side of the compressor 714 of the outdoor unit 612 through the second 3-way valve 744 of the flow path switching apparatus 632. If the bypass valve 746 is opened, the low-pressure gaseous refrigerant recovered from the indoor unit mode controller 652 to the flow path switching apparatus 632 may be recovered toward the outdoor unit 612 through the second refrigerant pipe 674 in addition to the third refrigerant pipe 676. That is, the low-pressure gaseous refrigerant may alternatively or additionally flow from the indoor unit mode controller 652 through the second refrigerant pipe 674, then through the bypass valve 746 to the third refrigerant pipe 676. Since the second check valve 738 is closed, the low-pressure gaseous refrigerant recovered from the indoor unit mode controller 652 to the outdoor unit 612 does not flow into the inhalation side of the compressor 714 through the refrigerant branching pipe 692. As a result, one-cycle refrigerant circulation passing through the outdoor unit 612 and the flow path switching apparatus 632 in the air-conditioning operation mode is completed.

Figure 9:
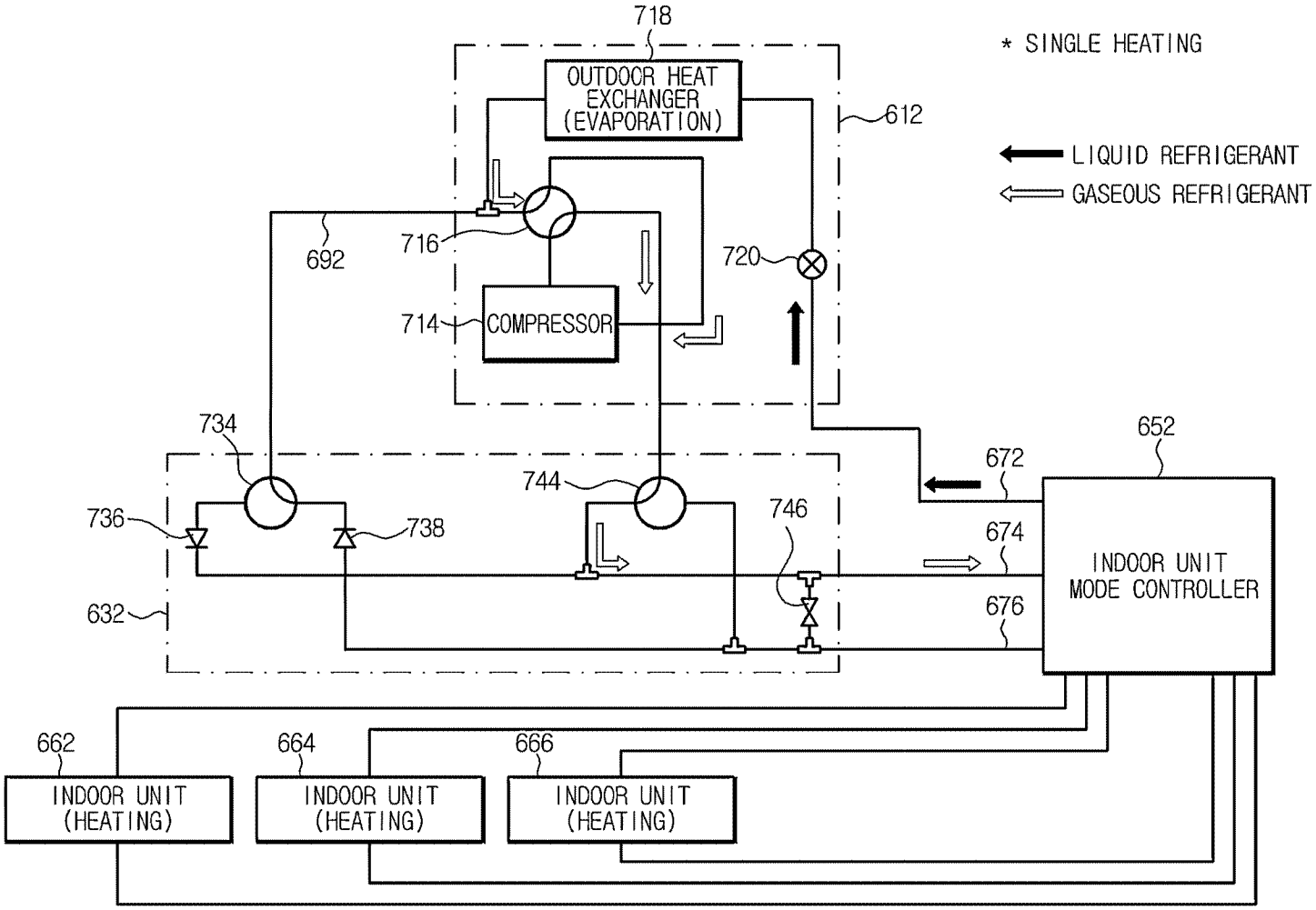
FIG. 9 illustrates a single heating mode of the heat pump of FIG. 7.

FIG. 9 illustrates a single heating mode of the heat pump of FIG. 7. As illustrated in FIG. 9, as a heating operation is required in all of the plurality of indoor units 662, 664, and 666, the plurality of indoor units 662, 664, and 666 operate in a heating operation mode, and indoor heat exchangers of each of the plurality of indoor units 662, 664, and 666 operate as condensers for heating. Also, the outdoor unit 612 also operates in the heating operation mode, and the outdoor heat exchanger 718 of the outdoor unit 612 operates as an evaporator.

With respect to the outdoor unit 612, in regard to a flow path switching state of the 4-way valve 716, a refrigerant flow path is formed between the ejection side of the compressor 714 and the second 3-way valve 744 of the flow path switching apparatus 632. Also, due to the 4-way valve 716 of the outdoor unit 612, a refrigerant flow path is formed between the inhalation side of the compressor 714 and one side of the outdoor heat exchanger 718. Due to the formation of the refrigerant flow path, a refrigerant flow path is formed between the inhalation side of the compressor 714 and the first 3-way valve 734 of the flow path switching apparatus 632 through the refrigerant branching pipe 692. Here, the second check valve 738 is closed so that the refrigerant does not flow into the compressor 714 through the refrigerant branching pipe 692. The first 3-way valve 734 of the flow path switching apparatus 632 does not constitute a refrigerant flow path through the second refrigerant pipe 674 and constitutes a refrigerant flow path only through the third refrigerant pipe 676. Unlike this, the second 3-way valve 744 of the flow path switching apparatus 632 does not constitute a refrigerant flow path through the third refrigerant pipe 676 and constitutes a refrigerant flow path only through the second refrigerant pipe 674. By switching the flow path of the 4-way valve 716 of the outdoor unit 612 and the second 3-way valve 744 of the flow path switching apparatus 632 in this way, a high-temperature high-pressure gaseous refrigerant ejected from the compressor 714 flows into the indoor unit mode controller 652 through the second 3-way valve 744 of the flow path switching apparatus 632. The indoor unit mode controller 652 supplies the high-temperature gaseous refrigerant flowing from the outdoor unit 612 to each of the plurality of indoor units 662, 664, and 666 so that heating can be performed in all of the plurality of indoor units 662, 664, and 666. Heating in each of the plurality of indoor units 662, 664, and 666 is performed by heat-exchange between the high-temperature gaseous refrigerant and the indoor air. A liquid refrigerant liquefied while contributing to heating in the plurality of indoor units 662, 664, and 666 flows into the indoor unit mode controller 652 and then flows into the outdoor unit 612 through the first refrigerant pipe 672. The liquid refrigerant flowing into the outdoor unit 612 is throttled by the electronic expansion valve 720 of the outdoor unit 612, passes through the outdoor heat exchanger 718 of the outdoor unit 612, and is gasified, and then flows into the inhalation side of the compressor 714. Since the second check valve 738 is closed, the low-pressure gaseous refrigerant recovered from the indoor unit mode controller 652 to the outdoor unit 612 does not flow into the inhalation side of the compressor 714 through the refrigerant branching pipe 692. As a result, one-cycle refrigerant circulation passing through the outdoor unit 612 and the flow path switching apparatus 632 in the heating operation mode is completed.

Figure 10:
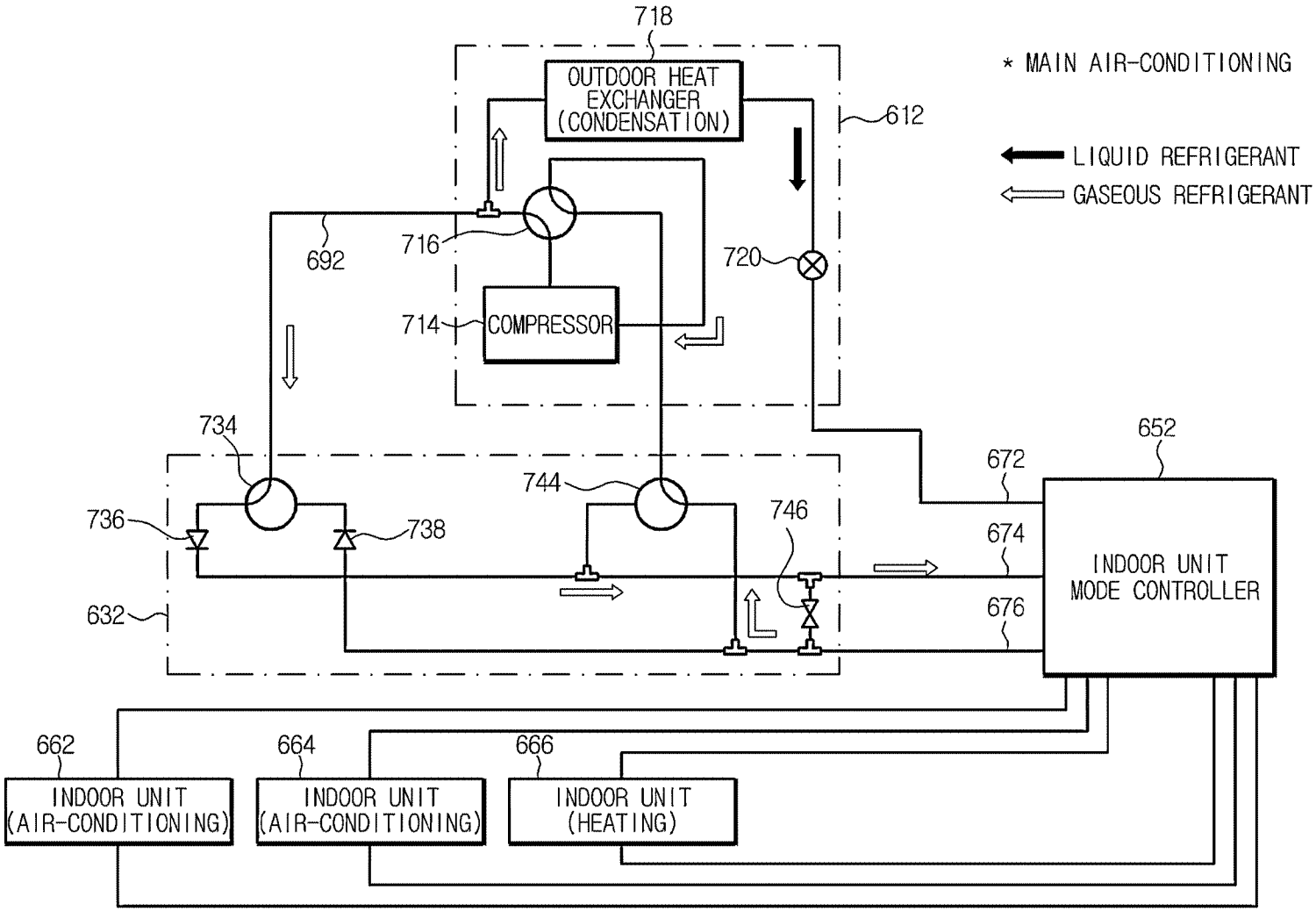
FIG. 10 illustrates a main air-conditioning mode of the heat pump of FIG. 7.

FIG. 10 illustrates a main air-conditioning mode of the heat pump of FIG. 7. As illustrated in FIG. 10, as an air-conditioning operation is required in the first indoor unit 662 and the second indoor unit 664 from among the plurality of indoor units 662, 664, and 666 and a heating operation is required in the third indoor unit 666, the first indoor unit 662 and the second indoor unit 664 operate in an air-conditioning operation mode, and the third indoor unit 666 operates in a heating operation mode. Indoor heat exchangers of each of the first indoor unit 662 and the second indoor unit 664 operate as evaporators for air-conditioning, and an indoor heat exchanger of the third indoor unit 666 operates as a condenser for heating. The outdoor unit 612 operates in the air-conditioning operation mode, and the outdoor heat exchanger 718 of the outdoor unit 612 operates as a condenser.

With respect to the outdoor unit 612, in regard to the flow path switching state of the 4-way valve 716, a refrigerant flow path is formed between the ejection side of the compressor 714 and one side of the outdoor heat exchanger 718. Due to the formation of the refrigerant flow path, a refrigerant flow path may be formed between the inhalation side of the compressor 714 and the first 3-way valve 734 of the flow path switching apparatus 632 through the refrigerant branching pipe 692. Also, due to the 4-way valve 716 of the outdoor unit 612, a refrigerant flow path is formed between the inhalation side of the compressor 714 and the second 3-way valve 744 of the flow path switching apparatus 632. The first 3-way valve 734 of the flow path switching apparatus 632 constitutes a refrigerant flow path through the second refrigerant pipe 674 and does not constitute a refrigerant flow path through the third refrigerant pipe 676. Unlike this, the second 3-way valve 744 of the flow path switching apparatus 632 does not constitute a refrigerant flow path through the second refrigerant pipe 674 and constitutes a refrigerant flow path only through the third refrigerant pipe 676. By switching the flow path of the 4-way valve 716 of the outdoor unit 612 and the first 3-way valve 734 of the flow path switching apparatus 632 in this way, a high-temperature high-pressure gaseous refrigerant ejected from the compressor 714 is condensed by the outdoor heat exchanger 718 and is liquefied and then flows into the indoor unit mode controller 652 through the second refrigerant pipe 672. The indoor unit mode controller 652 supplies the liquid refrigerant flowing from the outdoor unit 612 to each of the first indoor unit 662 and the second indoor unit 664 so that heating can be performed in the first indoor unit 662 and the second indoor unit 664. Heating in each of the first indoor unit 662 and the second indoor unit 664 is performed by heat-exchange between the refrigerant, the temperature of which is lowered by evaporation of the liquid refrigerant due to a throttling action and the indoor air. A low-pressure gaseous refrigerant that contributes to air-conditioning due to evaporation in the first indoor unit 662 and the second indoor unit 664 flows into the indoor unit mode controller 652, flows into the flow path switching apparatus 632 through the third refrigerant pipe 676, and then flows into the inhalation side of the compressor 714 of the outdoor unit 612 through the second 3-way valve 744 of the flow path switching apparatus 632. If the bypass valve 746 is opened, the low-pressure gaseous refrigerant recovered from the indoor unit mode controller 652 to the flow path switching apparatus 632 may be recovered toward the outdoor unit 612 through the second refrigerant pipe 674 in addition to the third refrigerant pipe 676. Since the first check valve 736 is opened, the high-temperature high-pressure gaseous refrigerant ejected from the compressor 714 flows into the indoor unit mode controller 652 via the refrigerant branching pipe 692, the first 3-way valve 734, the first check valve 736 and the second refrigerant pipe 674. The indoor unit mode controller 652 supplies the high-temperature high-pressure gaseous refrigerant flowing through the second refrigerant pipe 674 to the third indoor unit 666 that requires heating so that heating can be performed in the third indoor unit 666. Heating in the third indoor unit 666 is performed by heat-exchange between the high-temperature gaseous refrigerant and the indoor air. As a result, one-cycle refrigerant circulation passing through the outdoor unit 612 and the flow path switching apparatus 632 in the main air-conditioning operation mode is completed.

Figure 11:
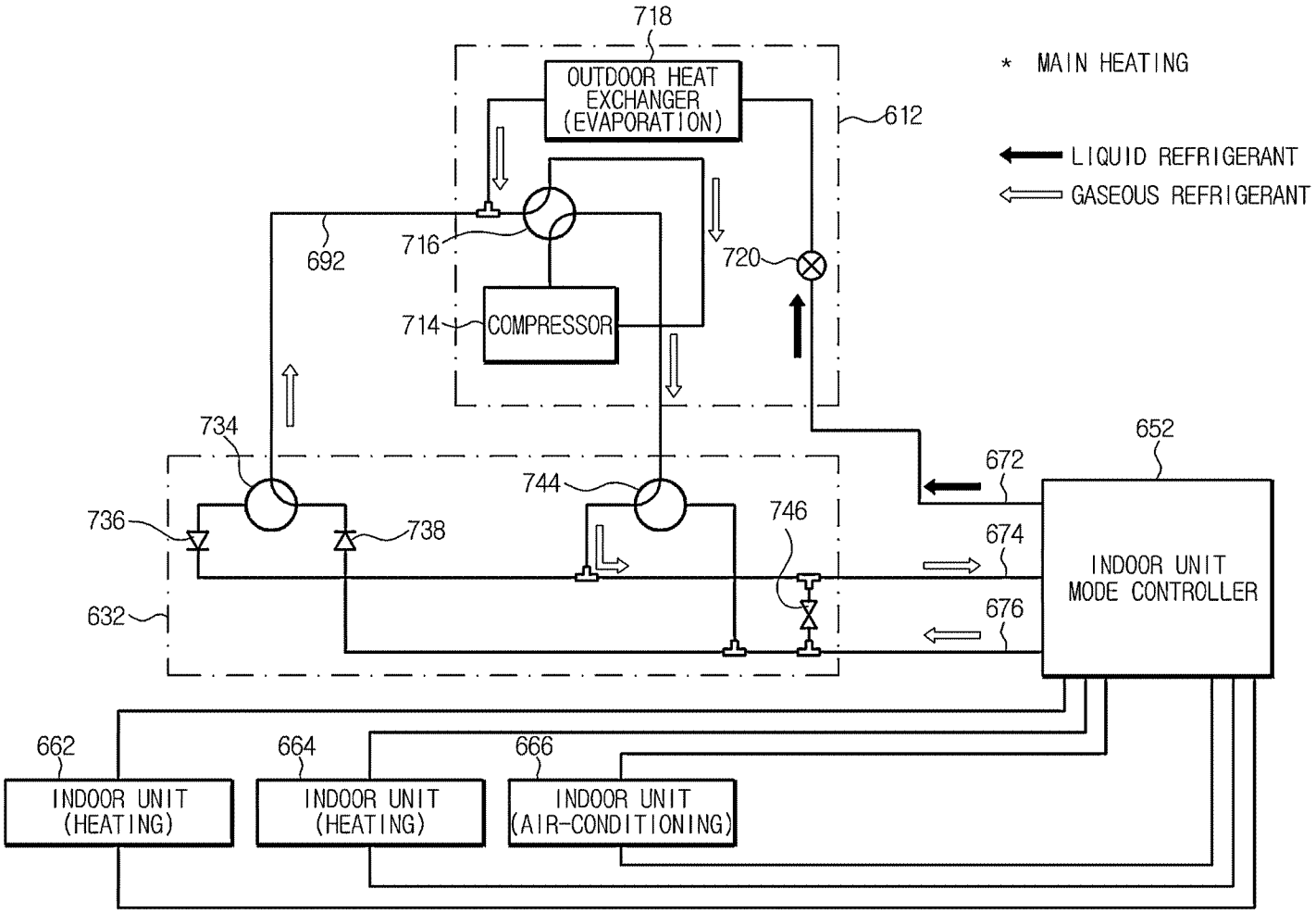
FIG. 11 illustrates a main heating mode of the heat pump of FIG. 7.

FIG. 11 illustrates a main heating mode of the heat pump of FIG. 7. As illustrated in FIG. 11, as a heating operation is required in the first indoor unit 662 and the second indoor unit 664 from among the plurality of indoor units 662, 664, and 666 and an air-conditioning operation is required in the third indoor unit 666, the first indoor unit 662 and the second indoor unit 664 operate in a heating operation mode, and the third indoor unit 666 operates in an air-conditioning operation mode. Indoor heat exchangers of each of the first indoor unit 662 and the second indoor unit 664 operate as condensers for heating, and an indoor heat exchanger of the third indoor unit 666 operates an evaporator for air-conditioning. The outdoor unit 612 operates in the heating operation mode, and the outdoor heat exchanger 718 of the outdoor unit 612 operates as a condenser.

With respect to the outdoor unit 612, in regard to the flow path switching state of the 4-way valve 716, a refrigerant flow path is formed between the ejection side of the compressor 714 and the second 3-way valve 744 of the flow path switching apparatus 632. Also, due to the 4-way valve 716 of the outdoor unit 612, a refrigerant flow path is formed between the inhalation side of the compressor 714 and one side of the outdoor heat exchanger 718. Due to the formation of the refrigerant flow path, a refrigerant flow path may be formed between the inhalation side of the compressor 714 and the first 3-way valve 734 of the flow path switching apparatus 632 through the refrigerant branching pipe 692. Here, the second check valve 738 may be opened so that the refrigerant flowing from the indoor unit mode controller 652 through the third refrigerant pipe 676 flows into the inhalation side of the compressor 714 through the refrigerant branching pipe 692. The first 3-way valve 734 of the flow path switching apparatus 632 does not constitute a refrigerant flow path through the second refrigerant pipe 674 and constitutes a refrigerant flow path only through the third refrigerant pipe 676. Unlike this, the second 3-way valve 744 of the flow path switching apparatus 632 does not constitute a refrigerant flow path through the third refrigerant pipe 676 and constitutes a refrigerant flow path only through the second refrigerant pipe 674. By switching the flow path of the 4-way valve 716 of the outdoor unit 612 and the second 3-way valve 744 of the flow path switching apparatus 632 in this way, a high-temperature high-pressure gaseous refrigerant ejected from the compressor 714 flows into the indoor unit mode controller 652 through the second 3-way valve 744 of the flow path switching apparatus 632. The indoor unit mode controller 652 supplies the high-temperature gaseous refrigerant flowing from the outdoor unit 612 to each of the plurality of indoor units 662, 664, and 666 so that heating can be performed in all of the plurality of indoor units 662, 664, and 666. Heating in each of the plurality of indoor units 662, 664 and 666 is performed by heat-exchange between the high-temperature gaseous refrigerant and the indoor air. A liquid refrigerant liquefied while contributing to heating in the plurality of indoor units 662, 664 and 666 flows into the indoor unit mode controller 652 and then flows into the outdoor unit 612 through the first refrigerant pipe 672. The liquid refrigerant flowing into the outdoor unit 612 is throttled by the electronic expansion valve 720 of the outdoor unit 612, passes through the outdoor heat exchanger 718 of the outdoor unit 612 and is gasified, and then flows into the inhalation side of the compressor 714. Since the second check valve 738 is opened, the low-pressure gaseous refrigerant that contributes to air-conditioning in the third indoor unit 666 flows into the indoor unit mode controller 652 and then flows into the inhalation side of the compressor 714 through the third refrigerant pipe 676, the second check valve 738, and the refrigerant branching pipe 692. Air-conditioning in the third indoor unit 666 is performed by heat-exchange between the refrigerant, the temperature of which is lowered by evaporation of the liquid refrigerant due to a throttling action, and the indoor air. As a result, one-cycle refrigerant circulation passing through the outdoor unit 612 and the flow path switching apparatus 632 in the main heating operation mode is completed.

Figure 12:
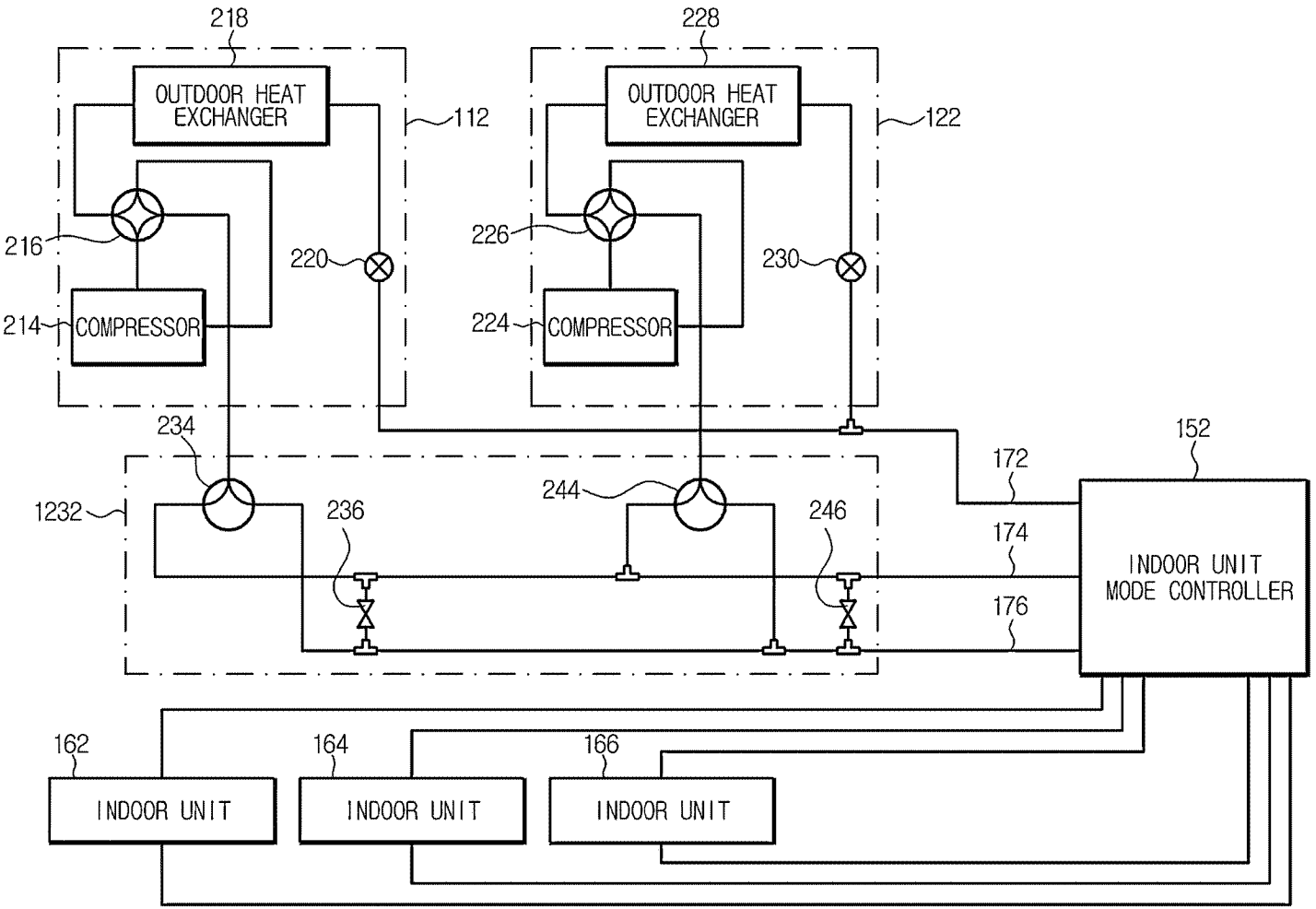
FIG. 12 illustrates a flow path switching apparatus of the refrigerant cycle of the heat pump illustrated in FIG. 2, in accordance with an embodiment of the disclosure.

FIG. 12 illustrates a flow path switching apparatus of the refrigerant cycle of the heat pump illustrated in FIG. 2, in accordance with an embodiment of the disclosure. The heat pump illustrated in FIG. 12 includes a plurality of outdoor units 112 and 122 and a single flow path switching apparatus 1232.

In a first outdoor unit 112, a 4-way valve 216 may be connected between an ejection side and an inhalation side of the compressor 214 via a pipe. The 4-way valve 216 connects the ejection side of the compressor 214 to one side of an outdoor heat exchanger 218 or a first 3-way valve 234 of the flow path switching apparatus 1232 and connects the inhalation side of the compressor 214 to one side of the outdoor heat exchanger 218 or a second 3-way valve 244 of the flow path switching apparatus 1232. Due to the action of the 4-way valve 216, the high-temperature and high-pressure gaseous refrigerant ejected from the compressor 214 may be transmitted to one of the outdoor heat exchanger 218 and the first 3-way valve 234 of the flow path switching apparatus 1232, and a low-pressure gaseous refrigerant transmitted from one of the outdoor heat exchanger 218 and the first 3-way valve of the flow path switching apparatus 1232 may be transmitted to the inhalation side of the compressor 214. A first refrigerant pipe 172 may be connected to the other side of the outdoor heat exchanger 218, and an electronic expansion valve 220 may be installed on the way of the first refrigerant pipe 172. The electronic expansion valve 220 of the first outdoor unit 112 operates as a throttling unit that drops pressure of the refrigerant flowing into the outdoor heat exchanger 218 by adjusting the valve opening degree in the heating operation mode and causes the refrigerant condensed by the outdoor heat exchanger 218 to smoothly flow into the indoor unit mode controller 152 in the air-conditioning operation mode, because the valve opening degree is sufficient. That is, the electronic expansion valve 220 of the first outdoor unit 112 operates as a throttling unit that drops pressure of the refrigerant flowing into the outdoor heat exchanger 218 by adjusting the valve opening degree when the outdoor heat exchanger 218 acts as or operates as an evaporator, and the electronic expansion valve 220 causes the refrigerant condensed by the outdoor heat exchanger 218 to smoothly flow into the indoor unit mode controller 152 when the outdoor heat exchanger 218 acts as or operates as a condenser, because the valve opening degree is sufficient.

The second outdoor unit 122 also has a similar structure to that of the first outdoor unit 112. That is, in the second outdoor unit 122, a 4-way valve 226 may be connected between the ejection side and the inhalation side of a compressor 224 via a pipe. The 4-way valve 226 connects the ejection side of the compressor 224 to one side of the outdoor heat exchanger 228 or the second 3-way valve 244 of the flow path switching apparatus 1232 and connects the inhalation side of the compressor 224 to one side of the outdoor heat exchanger 228 or the second 3-way valve 244 of the flow path switching apparatus 1232. Due to the action of the 4-way valve 226, the high-pressure refrigerant ejected from the compressor 224 may be transmitted to one of the outdoor heat exchanger 228 and the second 3-way valve 244 of the flow path switching apparatus 1232, and the low-pressure refrigerant transmitted from one of the outdoor heat exchanger 228 and the second 3-way valve 244 of the flow path switching apparatus 1232 may be transmitted to the inhalation side of the compressor 224. The first refrigerant pipe 172 may be connected to the other side of the outdoor heat exchanger 228, and an electronic expansion valve 230 may be installed on the way of the first refrigerant pipe 172. The electronic expansion valve 230 of the second outdoor unit 122 operates as a throttling unit that drops the pressure of the refrigerant flowing into the outdoor heat exchanger 228 by adjusting the valve opening degree in the heating operation mode and causes the refrigerant condensed by the outdoor heat exchanger 228 to smoothly flow into the indoor unit mode controller 152 in the air conditioning operation mode, because the valve opening degree is sufficient. That is, the electronic expansion valve 230 of the second outdoor unit 122 operates as a throttling unit that drops pressure of the refrigerant flowing into the outdoor heat exchanger 228 by adjusting the valve opening degree when the outdoor heat exchanger 228 acts as or operates as an evaporator, and the electronic expansion valve 230 causes the refrigerant condensed by the outdoor heat exchanger 228 to smoothly flow into the indoor unit mode controller 152 when the outdoor heat exchanger 228 acts as or operates as a condenser, because the valve opening degree is sufficient.

The flow path switching apparatus 1232 may include a first 3-way valve 234, a second 3-way valve 244, a first bypass valve 236, and a second bypass valve 246. The first 3-way valve 234 causes one of the second refrigerant pipe 174 and the third refrigerant pipe 176 to be connected to the 4-way valve 216 of the first outdoor unit 112. In other words, the first 3-way valve 234 of the flow path switching apparatus 1232 causes a gas pipe connected to the 4-way valve 216 of the first outdoor unit 112 to diverge from one of the second refrigerant pipe 174 and the third refrigerant pipe 176 and to reach the indoor unit mode controller 152. Within the flow path switching apparatus 1232, the first bypass valve 236 may be installed between the second refrigerant pipe 174 and the third refrigerant pipe 176. In particular, the first bypass valve 236 may be installed between a place where the second 3-way valve 244 is connected to the second refrigerant pipe 174 and the third refrigerant pipe 176 and the first 3-way valve 234. The first bypass valve 236 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 176, so that the section can be used as a refrigerant flow path. The second 3-way valve 244 causes one of the second refrigerant pipe 174 and the third refrigerant pipe 176 to be connected to the 4-way valve 226 of the second outdoor unit 122. In other words, the second 3-way valve 244 of the flow path switching apparatus 1232 causes the gas pipe connected to the 4-way valve 226 of the second outdoor unit 122 to diverge from one of the second refrigerant pipe 174 and the third refrigerant pipe 176 and to reach the indoor unit mode controller 152. Within the flow path switching apparatus 1232, the second bypass valve 246 may be installed between the second refrigerant pipe 174 and the third refrigerant pipe 176. In particular, the second bypass valve 246 may be installed between a place where the second 3-way valve 244 is connected to the second refrigerant pipe 174 and the third refrigerant pipe 176 and the indoor unit mode controller 152. The second bypass valve 246 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 175, so that the section can be used as a refrigerant flow path.

Figure 13:
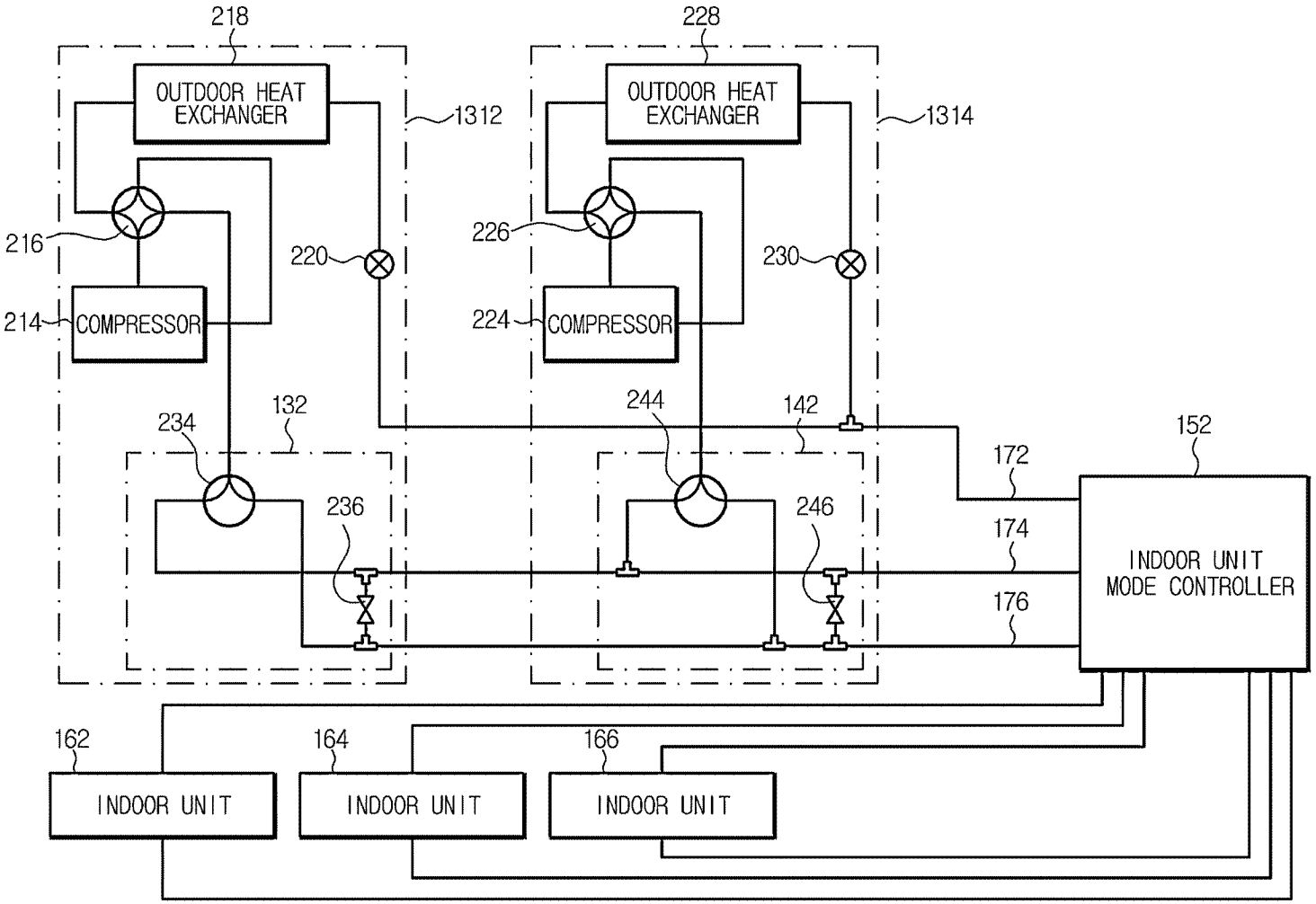
FIG. 13 illustrates a flow path switching apparatus of the refrigerant cycle of the heat pump illustrated in FIG. 2, in accordance with an embodiment of the disclosure.

FIG. 13 illustrates a flow path switching apparatus of the refrigerant cycle of the heat pump illustrated in FIG. 2, in accordance with an embodiment of the disclosure. The heat pump illustrated in FIG. 13 may include a plurality of outdoor units 1312 and 1322 and a plurality of flow path switching apparatuses 132 and 142, wherein a first flow path switching apparatus 132 is integrally disposed within a first outdoor unit 1312 and a second flow path switching apparatus 142 is integrally disposed within a second outdoor unit 1322. In this way, a flow path switching apparatus in accordance with an embodiment of the disclosure is integrally produced within an outdoor unit in a process of manufacturing the outdoor unit of the heat pump so that a simultaneous air-conditioning/heating operation can be performed without carrying out an additional installation work at a heat pump that is newly installed.

In the first outdoor unit 1312, a 4-way valve 216 may be connected between an ejection side and an inhalation side of a compressor 214 via a pipe. The 4-way valve 216 connects the ejection side of the compressor 214 to one side of an outdoor heat exchanger 218 or the first flow path switching apparatus 132 and connects the inhalation side of the compressor 214 to one side of the outdoor heat exchanger 218 or the first flow path switching apparatus 132. Due to the action of the 4-way valve 216, a high-temperature and high-pressure gaseous refrigerant ejected from the compressor 214 may be transmitted to one of the outdoor heat exchanger 218 and the first flow path switching apparatus 132, and a low-pressure gaseous refrigerant transmitted from one of the outdoor heat exchanger 218 and the first flow path switching apparatus 132 may be transmitted to the inhalation side of the compressor 214. A first refrigerant pipe 172 may be connected to the other side of the outdoor heat exchanger 218, and an electronic expansion valve 220 may be installed on the way of the first refrigerant pipe 172. The electronic expansion valve 220 of the first outdoor unit 1312 operates as a throttling unit that drops pressure of the refrigerant flowing into the outdoor heat exchanger 218 by adjusting the valve opening degree in the heating operation mode and causes the refrigerant condensed by the outdoor heat exchanger 218 to smoothly flow into the indoor unit mode controller 152 in the air-conditioning mode, because the valve opening degree is sufficient. That is, the electronic expansion valve 220 of the first outdoor unit 112 operates as a throttling unit that drops pressure of the refrigerant flowing into the outdoor heat exchanger 218 by adjusting the valve opening degree when the outdoor heat exchanger 218 acts as or operates as an evaporator, and the electronic expansion valve 220 causes the refrigerant condensed by the outdoor heat exchanger 218 to smoothly flow into the indoor unit mode controller 152 when the outdoor heat exchanger 218 acts as or operates as a condenser, because the valve opening degree is sufficient.

The second outdoor unit 1322 also has a similar structure to that of the first outdoor unit 1312. That is, in the second outdoor unit 1322, a 4-way valve 226 may be connected between the ejection side and the inhalation side of a compressor 224 via a pipe. The 4-way valve 226 connects the ejection side of the compressor 224 to one side of the outdoor heat exchanger 228 or the second flow path switching apparatus 142 and connects the inhalation side of the compressor 224 to one side of the outdoor heat exchanger 228 or the second flow path switching apparatus 142. Due to the action of the 4-way valve 226, the high-pressure refrigerant ejected from the compressor 224 may be transmitted to one of the outdoor heat exchanger 228 and the second flow path switching apparatus 142, and the low-pressure refrigerant transmitted from one of the outdoor heat exchanger 228 and the second flow path switching apparatus 142 may be transmitted to the inhalation side of the compressor 224. The first refrigerant pipe 172 may be connected to the other side of the outdoor heat exchanger 228, and an electronic expansion valve 230 may be installed on the way of the first refrigerant pipe 172. The electronic expansion valve 230 of the first outdoor unit 1312 operates as a throttling unit that drops the pressure of the refrigerant flowing into the outdoor heat exchanger 228 by adjusting the valve opening degree in the heating operation mode and causes the refrigerant condensed by the outdoor heat exchanger 228 to smoothly flow into the indoor unit mode controller 152 in the air-conditioning operation mode, because the valve opening degree is sufficient. That is, the electronic expansion valve 230 of the second outdoor unit 122 operates as a throttling unit that drops pressure of the refrigerant flowing into the outdoor heat exchanger 228 by adjusting the valve opening degree when the outdoor heat exchanger 228 acts as or operates as an evaporator, and the electronic expansion valve 230 causes the refrigerant condensed by the outdoor heat exchanger 228 to smoothly flow into the indoor unit mode controller 152 when the outdoor heat exchanger 228 acts as or operates as a condenser, because the valve opening degree is sufficient.

The first flow path switching apparatus 132 may include a 3-way valve 234 and a bypass valve 236. The 3-way valve 234 causes one of the second refrigerant pipe 174 and the third refrigerant pipe 176 to be connected to the 4-way valve 216 of the first outdoor unit 1312. In other words, the first flow path switching apparatus 132 causes a gas pipe connected to the 4-way valve 216 of the first outdoor unit 1312 to diverge from one of the second refrigerant pipe 174 and the third refrigerant pipe 176 and to reach the indoor unit mode controller 152. Within the first flow path switching apparatus 132, a bypass valve 236 may be installed between the second refrigerant pipe 174 and the third refrigerant pipe 176. The bypass valve 236 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 176, so that the section can be used as a refrigerant flow path.

The configuration or arrangement of the second flow path switching apparatus 142 is also similar to that of the first flow path switching apparatus 1322. That is, the second flow path switching apparatus 142 may include a 3-way valve 244 and a bypass valve 246. The 3-way valve 244 causes one of the second refrigerant pipe 174 and the third refrigerant pipe 176 to be connected to the 4-way valve 226 of the second outdoor unit 1322. In other words, the second flow path switching apparatus 142 causes a gas pipe connected to the 4-way valve 226 of the second outdoor unit 1322 to diverge from one of the second refrigerant pipe 174 and the third refrigerant pipe 176 and to reach the indoor unit mode controller 152. Within the second flow path switching apparatus 142, a bypass valve 246 may be installed between the second refrigerant pipe 174 and the third refrigerant pipe 176. The bypass valve 246 causes pressure inside the second refrigerant pipe 174 and pressure inside the third refrigerant pipe 176 to be equalized or the refrigerant to flow in a partial section that is not used by one of the second refrigerant pipe 174 and the third refrigerant pipe 176, so that the section can be used as a refrigerant flow path.

The first flow path switching apparatus 132 and the second flow path switching apparatus 142 switch a refrigerant flow path between the plurality of outdoor units 1312 and 1322 and the indoor unit mode controller 152 so that an air-conditioning/heating operation required in each of the plurality of indoor units 162, 164 and 166 can be performed, in consideration of an air-conditioning/heating operation required in the plurality of indoor units 162, 164 and 166 and an air-conditioning/heating operation state of each of the plurality of outdoor units 1312 and 1322.

Figure 14:
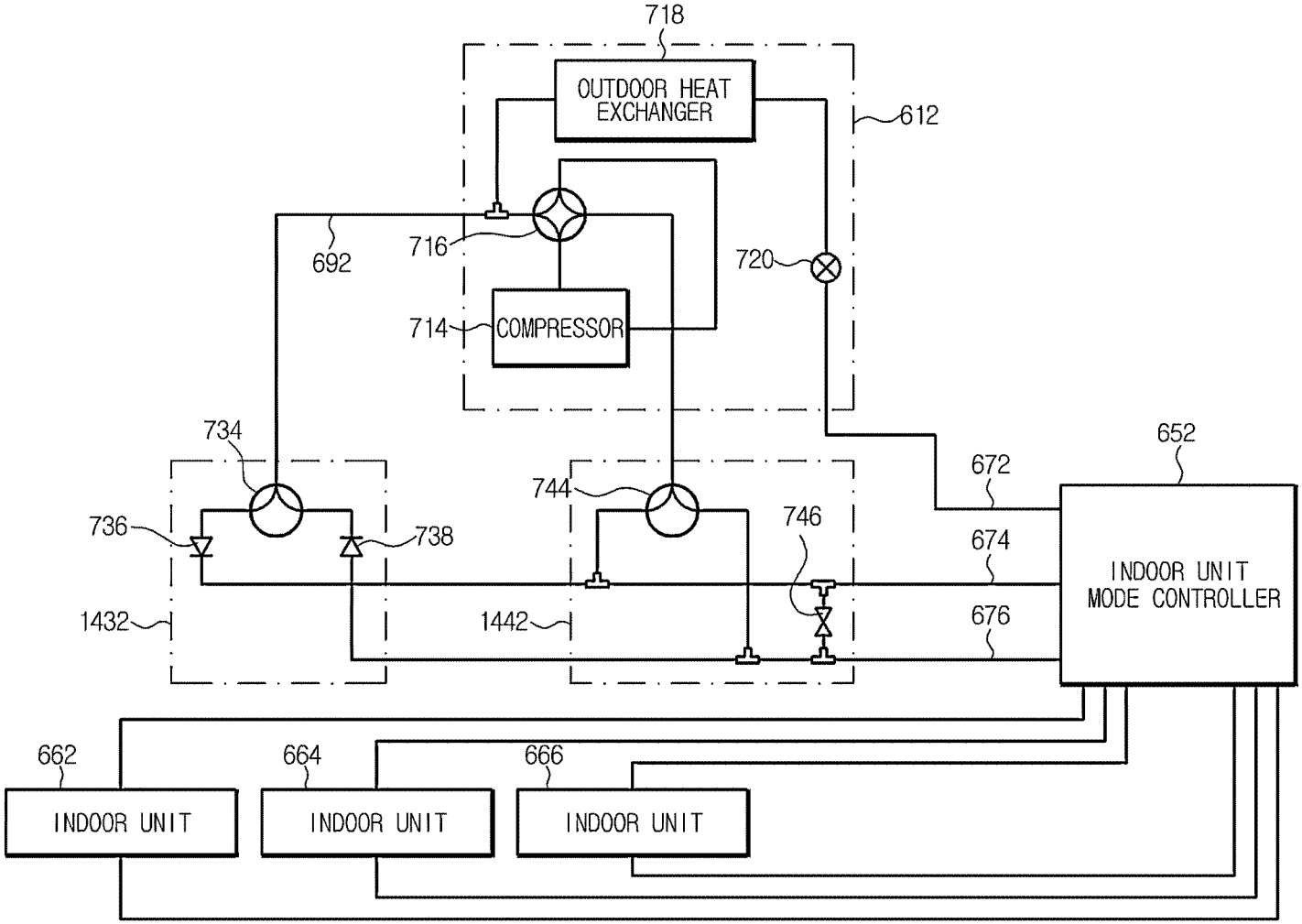
FIG. 14 illustrates a flow path switching apparatus of the refrigerant cycle of the heat pump illustrated in FIG. 7, in accordance with an embodiment of the disclosure.

FIG. 14 illustrates a flow path switching apparatus of the refrigerant cycle of the heat pump illustrated in FIG. 7, in accordance with an embodiment of the disclosure. The heat pump illustrated in FIG. 14 includes a single outdoor unit 612 and a plurality of flow path switching apparatuses 1432 and 1442.

In the outdoor unit 612, a 4-way valve 716 may be connected between an ejection side and an inhalation side of a compressor 714 via a pipe. The 4-way valve 716 connects the ejection side of the compressor 714 to one side of an outdoor heat exchanger 718, the first flow path switching apparatus 1432, or the second flow path switching apparatus 1442 and connects the inhalation side of the compressor 714 to one side of the outdoor heat exchanger 718, the first flow path switching apparatus 1432, or the second flow path switching apparatus 1442. Due to the action of the 4-way valve 716, a high-pressure refrigerant ejected from the compressor 714 may be transmitted to one of the outdoor heat exchanger 718 and the first flow path switching apparatus 1432 or the second flow path switching apparatus 1442, and a low-pressure refrigerant transmitted from one of the outdoor heat exchanger 718, the first flow path switching apparatus 1432 and the second flow path switching apparatus 1442 may be transmitted to the inhalation side of the compressor 714. A first refrigerant pipe 672 may be connected to the other side of the outdoor heat exchanger 718, and an electronic expansion valve 720 may be installed on the way of the first refrigerant pipe 672. The electronic expansion valve 720 of the outdoor unit 612 operates as a throttling unit that drops pressure of the refrigerant flowing into the outdoor heat exchanger 718 by adjusting the valve opening degree in the heating operation mode and causes the refrigerant condensed by the outdoor heat exchanger 718 to smoothly flow into the indoor unit mode controller 652 in the air-conditioning mode, because the valve opening degree is sufficient. That is, the electronic expansion valve 720 of the outdoor unit 612 operates as a throttling unit that drops pressure of the refrigerant flowing into the outdoor heat exchanger 718 by adjusting the valve opening degree when the outdoor heat exchanger 718 acts as or operates as an evaporator, and the electronic expansion valve 720 causes the refrigerant condensed by the outdoor heat exchanger 718 to smoothly flow into the indoor unit mode controller 652 when the outdoor heat exchanger 718 acts as or operates as a condenser, because the valve opening degree is sufficient. As discussed above with respect to FIG. 10, the outdoor heat exchanger may operate as an evaporator in a main heating mode, when a plurality or majority of indoor units require a heating operation while other indoor units require an air-conditioning operation. As discussed above with respect to FIG. 11, the outdoor heat exchanger 718 may operate as a condenser in a main air-conditioning mode, when a plurality or majority of indoor units require an air-conditioning operation while other indoor units require a heating operation.

The first flow path switching apparatus 1432 may include a 3-way valve 734, a first check valve 736, and a second check valve 738. A refrigerant branching pipe 692 may be a refrigerant pipe that branches from a place where the 4-way valve 716 and one side of the outdoor heat exchanger 718 are connected to each other and that is connected to a first 3-way valve 734 of the flow path switching apparatus 1432. The first 3-way valve 734 causes one of the second refrigerant pipe 674 and the third refrigerant pipe 676 to be connected to the 4-way valve 716 of the outdoor unit 612 via the refrigerant branching pipe 692. In other words, the first flow path switching apparatus 1432 causes the refrigerant branching pipe 692 that branches between the 4-way valve 716 of the outdoor unit 612 and the outdoor heat exchanger 718 to diverge from one of the second refrigerant pipe 674 and the third refrigerant pipe 676 and to reach the indoor unit mode controller 652. Within the first flow path switching apparatus 1432, the first check valve 736 that forcibly induces the flow of the refrigerant in a direction of the indoor unit mode controller 652 from the first 3-way valve 734 may be installed on the second refrigerant pipe 674 connected to the first 3-way valve 734. Also, within the first flow path switching apparatus 1432, the second check valve 738 that forcibly induces the flow of the refrigerant in a direction of the first 3-way valve 734 from the indoor unit mode controller 652 may be installed on the third refrigerant pipe 676 connected to the first 3-way valve 734.

The second flow path switching apparatus 1442 may include a second 3-way valve 744 and one bypass valve 746. The second 3-way valve 744 causes one of the second refrigerant pipe 674 and the third refrigerant pipe 676 to be connected to the 4-way valve 716 of the outdoor unit 612. In other words, the second flow path switching apparatus 1442 causes a refrigerant pipe connected to the 4-way valve 716 of the outdoor unit 612 to diverge from one of the second refrigerant pipe 674 and the third refrigerant pipe 676 and to reach the indoor unit mode controller 652. Within the second flow path switching apparatus 1442, the bypass valve 746 may be installed between the second refrigerant pipe 674 and the third refrigerant pipe 676. In particular, the bypass valve 746 may be installed between a place where the second 3-way valve 744 is connected to the second refrigerant pipe 674 and the third refrigerant pipe 676, and the indoor unit mode controller 652. The bypass valve 746 causes pressure inside the second refrigerant pipe 674 and pressure inside the third refrigerant pipe 676 to be equalized or the refrigerant to flow in a partial section that is not used by one of the second refrigerant pipe 674 and the third refrigerant pipe 676, so that the section can be used as a refrigerant flow path (see the description of FIG. 8).

The first flow path switching apparatus 1432 and the second flow path switching apparatus 1442 switch a refrigerant flow path between the outdoor unit 612 and the indoor unit mode controller 652 so that an air-conditioning/heating operation required in each of the plurality of indoor units 662, 664 and 666 can be performed, in consideration of an air-conditioning/heating operation required in the plurality of indoor units 662, 664 and 666 and an air-conditioning/heating operation state of the outdoor unit 612.

Figure 15:
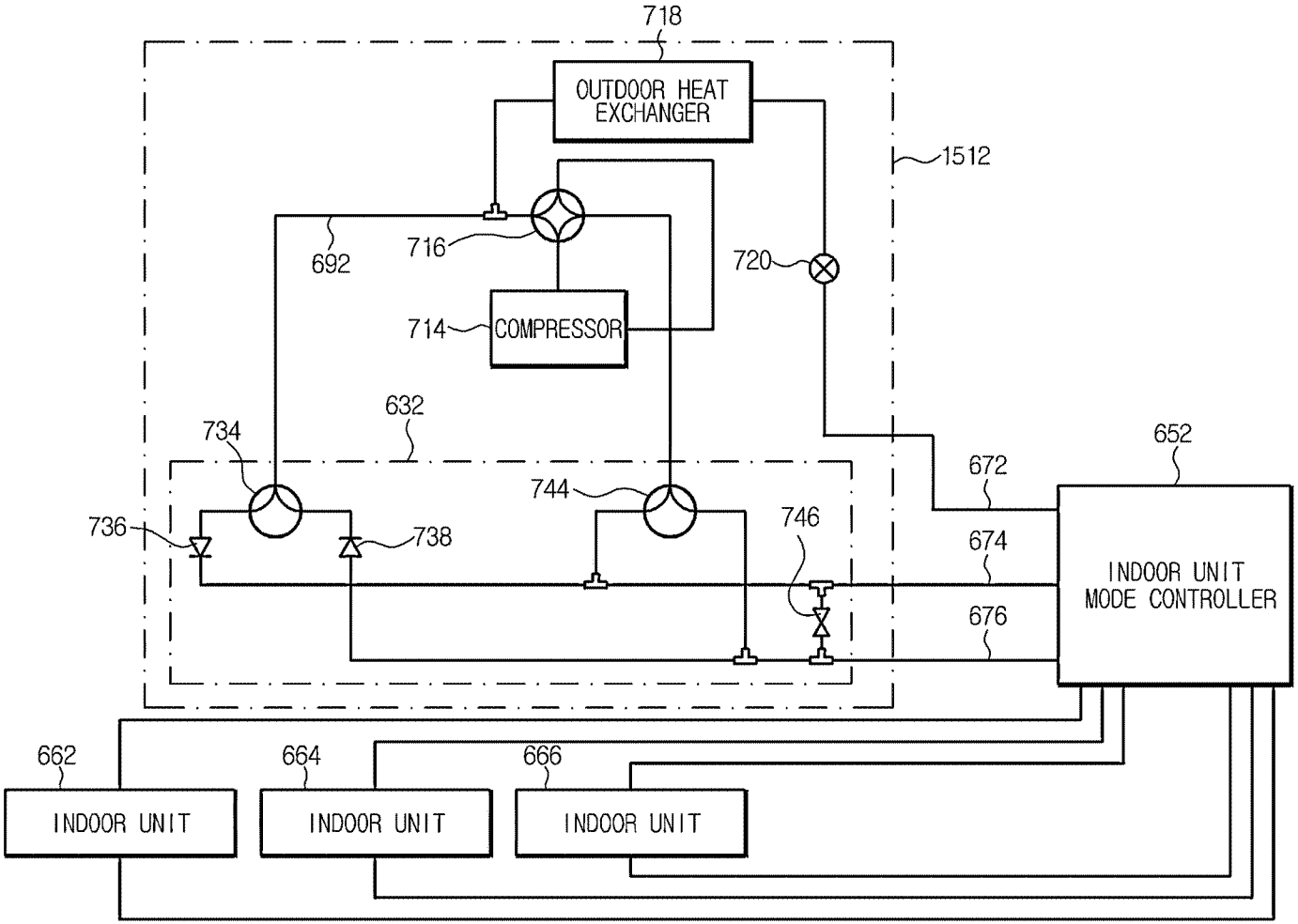
FIG. 15 illustrates a flow path switching apparatus of the refrigerant cycle of the heat pump illustrated in FIG. 7, in accordance with an embodiment of the disclosure.

FIG. 15 illustrates a flow path switching apparatus of the refrigerant cycle of the heat pump illustrated in FIG. 7, in accordance with an embodiment of the disclosure. The heat pump illustrated in FIG. 15 may include a single outdoor unit 1512 and a single flow path switching apparatus 632, wherein the flow path switching apparatus 632 is integrally disposed within the outdoor unit 1512. In this way, a flow path switching apparatus in accordance with an embodiment of the disclosure is integrally produced within an outdoor unit in a process of manufacturing the outdoor unit of the heat pump so that a simultaneous air-conditioning/heating operation can be performed without additional installation work at a heat pump that is newly installed.

In the outdoor unit 1512, a 4-way valve 716 may be connected between an ejection side and an inhalation side of a compressor 714 via a pipe. The 4-way valve 716 connects the ejection side of a compressor 714 to one side of an outdoor heat exchanger 718 or the flow path switching apparatus 632, connects the inhalation side of the compressor 714 to one side of the outdoor heat exchanger 718 or the flow path switching apparatus 632. Due to the action of the 4-way valve 716, a high-pressure refrigerant ejected from the compressor 714 may be transmitted to one of the outdoor heat exchanger 718 and the flow path switching apparatus 632, and a low-pressure refrigerant transmitted from one of the outdoor heat exchanger 718 and the flow path switching apparatus 632 may be transmitted to the inhalation side of the compressor 714. A first refrigerant pipe 672 may be connected to the other side of the outdoor heat exchanger 718, and an electronic expansion valve 720 is installed on the way of the first refrigerant pipe 672. The electronic expansion valve 720 of the outdoor unit 1512 operates as a throttling unit that drops pressure of the refrigerant flowing into the outdoor heat exchanger 718 by adjusting the valve opening degree in a heating operation mode and causes the refrigerant condensed by the outdoor heat exchanger 718 to smoothly flow into the indoor unit mode controller 652 in an air-conditioning operation mode, because the valve opening degree is sufficient. That is, the electronic expansion valve 720 of the outdoor unit 612 operates as a throttling unit that drops pressure of the refrigerant flowing into the outdoor heat exchanger 718 by adjusting the valve opening degree when the outdoor heat exchanger 718 acts as or operates as an evaporator, and the electronic expansion valve 720 causes the refrigerant condensed by the outdoor heat exchanger 718 to smoothly flow into the indoor unit mode controller 652 when the outdoor heat exchanger 718 acts as or operates as a condenser, because the valve opening degree is sufficient. As discussed above with respect to FIG. 10, the outdoor heat exchanger 718 may operate as an evaporator in a main heating mode, when a plurality or majority of indoor units require a heating operation while other indoor units require an air-conditioning operation. As discussed above with respect to FIG. 11, the outdoor heat exchanger may operate as a condenser in a main air-conditioning mode, when a plurality or majority of indoor units require an air-conditioning operation while other indoor units require a heating operation.

The flow path switching apparatus 632 may include a plurality of 3-way valves, for example, a first 3-way valve 734 and a second 3-way valve 744, a plurality of check valves, for example, a first check valve 736 and a second check valve 738, and one bypass valve 746. A refrigerant branching pipe 692 may be a refrigerant pipe that branches from a place where the 4-way valve 716 and one side of the outdoor heat exchanger 718 are connected to each other and that is connected to a first 3-way valve 734 of the flow path switching apparatus 632. The first 3-way valve 734 causes one of the second refrigerant pipe 674 and the third refrigerant pipe 676 to be connected to the 4-way valve 716 of the outdoor unit 1512 via the refrigerant branching pipe 692. In other words, the flow path switching apparatus 632 causes the refrigerant branching pipe 692 that branches between the 4-way valve 716 of the outdoor unit 1512 and the outdoor heat exchanger 718 to diverge from one of the second refrigerant pipe 674 and the third refrigerant pipe 676 and to reach the indoor unit mode controller 652. Within the flow path switching apparatus 632, the first check valve 736 that forcibly induces the flow of the refrigerant in a direction of the indoor unit mode controller 652 from the first 3-way valve 734 may be installed on the second refrigerant pipe 674 connected to the first 3-way valve 734. Also, within the flow path switching apparatus 632, the second check valve 738 that forcibly induces the flow of the refrigerant in a direction of the first 3-way valve 734 from the indoor unit mode controller 652 may be installed on the third refrigerant pipe 676 connected to the first 3-way valve 734. The second 3-way valve 744 causes one of the second refrigerant pipe 674 and the third refrigerant pipe 676 to be connected to the 4-way valve 716 of the outdoor unit 1512. In other words, the flow path switching apparatus 632 causes the refrigerant pipe connected to the 4-way valve 716 of the outdoor unit 1512 to diverge from one of the second refrigerant pipe 674 and the third refrigerant pipe 676 and to reach the indoor unit mode controller 652. Within the flow path switching apparatus 632, the bypass valve 746 may be installed between the second refrigerant pipe 674 and the third refrigerant pipe 676. In particular, the bypass valve 746 may be installed between a place where the second 3-way valve 744 is connected to the second refrigerant pipe 674 and the third refrigerant pipe 676 and the indoor unit mode controller 652. The bypass valve 746 causes pressure inside the second refrigerant pipe 674 and pressure inside the third refrigerant pipe 676 to be equalized or the refrigerant to flow in a partial section that is not used by one of the second refrigerant pipe 674 and the third refrigerant pipe 676, so that the section can be used as a refrigerant flow path (see the description of FIG. 8).

The flow path switching apparatus 632 switches a refrigerant flow path between the outdoor unit 1512 and the indoor unit mode controller 652 so that an air-conditioning/heating operation required in each of the plurality of indoor units 662, 664 and 666 can be performed, in consideration of an air-conditioning/heating operation required in the plurality of indoor units 662, 664 and 666 and an air-conditioning/heating operation state of the outdoor unit 1512.

As described above, only a flow path switching apparatus is added to a heat pump so that a simultaneous air-conditioning/heating operation can be performed in the heat pump. In particular, an existing heat pump that has been already installed is separated from an outdoor unit and a flow path switching apparatus in accordance with the disclosure is additionally installed so that a simultaneous air-conditioning/heating operation may be performed, and a new heat pump that is newly installed can be integrally combined with the outdoor unit and may operate.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A flow path switching apparatus comprising:

a first 3-way valve including a first connection point, a second connection point, and a third connection point:

the first connection point of the first 3-way valve directly connectable to a high-pressure gas pipe connected to a plurality of indoor units of a heat pump;

the second connection point of the first 3-way valve directly connectable to a low-pressure gas pipe connected to the plurality of indoor units of the heat pump; and the third connection point of the first 3-way valve directly connectable to a first gas pipe directly connected to a compressor of a first outdoor unit of the heat pump, wherein the first 3-way valve is configured to switch between:

a first refrigerant flow path between the first connection point of the first 3-way valve and the third connection point of the first 3-way valve, connecting the first gas pipe connectable to the compressor of the first outdoor unit and the high-pressure gas pipe so that a high-pressure gaseous refrigerant received from the compressor of the first outdoor unit via the first gas pipe flows into the plurality of indoor units via the first 3-way valve and the high-pressure gas pipe, and a second refrigerant flow path between the second connection point of the first 3-way valve and the third connection point of the first 3-way valve, connecting the low-pressure gas pipe and the first gas pipe connectable to the compressor of the first outdoor unit so that a low-pressure gaseous refrigerant received from the plurality of indoor units flows into the first gas pipe connectable to the compressor of the first outdoor unit via the first 3-way valve and the low-pressure gas pipe.

2. The flow path switching apparatus of claim 1, further comprising:

a bypass valve, connectable to the high-pressure gas pipe and the low-pressure gas pipe, and configured to equalize a pressure inside the high-pressure gas pipe with a pressure inside the low-pressure gas pipe.

3. The flow path switching apparatus of claim 1, further comprising:

a bypass valve disposed between the high-pressure gas pipe and the low-pressure gas pipe to equalize pressure inside the high-pressure gas pipe and pressure inside the low-pressure gas pipe.

4. The flow path switching apparatus of claim 1, wherein the flow path switching apparatus is disposed separately from the outdoor unit.

5. The flow path switching apparatus of claim 2, wherein the first 3-way valve and the bypass valve are disposed separately from the outdoor unit.

6. The flow path switching apparatus of claim 1, further comprising:

a second 3-way valve including a first connection point, a second connection point, and a third connection point:

the first connection point of the second 3-way valve directly connectable to the high-pressure gas pipe directly connected to the plurality of indoor units of a heat pump;

the second connection point of the second 3-way valve directly connectable to the low-pressure gas pipe connected to the plurality of indoor units of the heat pump; and the third connection point of the second 3-way valve directly connectable to a second gas pipe directly connected to a compressor of a second outdoor unit of the heat pump, wherein the second 3-way valve is configured to switch between:

a third refrigerant flow path between the first connection point of the second 3-way valve and the third connection point of the second 3-way valve, connecting the second gas pipe connectable to the compressor of the second outdoor unit and the high-pressure gas pipe so that a high-pressure gaseous refrigerant received from the compressor of the second outdoor unit via the second gas pipe flows into the plurality of indoor units via the second 3-way valve and the high-pressure gas pipe, and a fourth refrigerant flow path between the second connection point of the second 3-way valve and the third connection point of the second 3-way valve, connecting the low-pressure gas pipe and the second gas pipe connectable to the compressor of the second outdoor unit so that a low-pressure gaseous refrigerant received from the plurality of indoor units flows into the second gas pipe connectable to the compressor of the second outdoor unit via the second 3-way valve and the low-pressure gas pipe.

7. A flow path switching apparatus comprising:

a first 3-way valve including a first connection point, a second connection point, and a third connection point:

the first connection point of the first 3-way valve connectable to a high-pressure gas pipe connected to a plurality of indoor units of a heat pump;

the second connection point of the first 3-way valve connectable to a low-pressure gas pipe connected to the plurality of indoor units of the heat pump; and the third connection point of the first 3-way valve connectable to a first gas pipe connectable to a compressor of a first outdoor unit of the heat pump, wherein the first 3-way valve is configured to switch between:

a first refrigerant flow path between the first connection point of the first 3-way valve and the third connection point of the first 3-way valve, connecting the first gas pipe connectable to the compressor of the first outdoor unit and the high-pressure gas pipe so that a high-pressure gaseous refrigerant received from the compressor of the first outdoor unit via the first gas pipe flows into the plurality of indoor units via the first 3-way valve and the high-pressure gas pipe, and a second refrigerant flow path between the second connection point of the first 3-way valve and the third connection point of the first 3-way valve, connecting the low-pressure gas pipe and the first gas pipe connectable to the compressor of the first outdoor unit so that a low-pressure gaseous refrigerant received from the plurality of indoor units flows into the first gas pipe connectable to the compressor of the first outdoor unit via the first 3-way valve and the low-pressure gas pipe;

a second 3-way valve including a first connection point, a second connection point, and a third connection point:

the first connection point of the second 3-way valve connectable to the high-pressure gas pipe connected to the plurality of indoor units of a heat pump;

the second connection point of the second 3-way valve connectable to the low-pressure gas pipe connected to the plurality of indoor units of the heat pump; and the third connection point of the second 3-way valve connectable to a second gas pipe connectable to a compressor of a second outdoor unit of the heat pump, wherein the second 3-way valve is configured to switch between:

a third refrigerant flow path between the first connection point of the second 3-way valve and the third connection point of the second 3-way valve, connecting the second gas pipe connectable to the compressor of the second outdoor unit and the high-pressure gas pipe so that a high-pressure gaseous refrigerant received from the compressor of the second outdoor unit via the second gas pipe flows into the plurality of indoor units via the second 3-way valve and the high-pressure gas pipe, and a fourth refrigerant flow path between the second connection point of the second 3-way valve and the third connection point of the second 3-way valve, connecting the low-pressure gas pipe and the second gas pipe connectable to the compressor of the second outdoor unit so that a low-pressure gaseous refrigerant received from the plurality of indoor units flows into the second gas pipe connectable to the compressor of the second outdoor unit via the second 3-way valve and the low-pressure gas pipe, wherein when a heating operation is simultaneously required in a first indoor unit among the plurality of indoor units together with a cooling operation in a second indoor unit among the plurality of indoor units, the first 3-way valve switches to the first refrigerant flow path between the compressor of the first outdoor unit and the high-pressure gas pipe so that a high-pressure gaseous refrigerant received from the compressor of the first outdoor unit flows into the first indoor unit via the first 3-way valve and the high-pressure gas pipe, and the second 3 way-valve switches to the fourth refrigerant flow path between the low-pressure gas pipe and the compressor of the second outdoor unit so that a low-pressure gaseous refrigerant received from the second indoor unit flows into the compressor of the second outdoor unit via the second 3-way valve and the low-pressure gas pipe.

* * * * *